US007491036B2

(12) United States Patent
Parent et al.

(10) Patent No.: US 7,491,036 B2
(45) Date of Patent: Feb. 17, 2009

(54) METHOD AND SYSTEM FOR COOLING A PUMP

(75) Inventors: Wayne M. Parent, Gilbert, AZ (US); Gentaro Goshi, Phoeniz, AZ (US)

(73) Assignee: Tokyo Electron Limited, Tokyo (JP)

( * ) Notice: Subject to any disclaimer, the term of this patent is extended or adjusted under 35 U.S.C. 154(b) by 512 days.

(21) Appl. No.: 10/987,066

(22) Filed: Nov. 12, 2004

(65) Prior Publication Data

US 2006/0104831 A1 May 18, 2006

(51) Int. Cl.
*F04B 39/06* (2006.01)
*F04B 39/04* (2006.01)
*F04F 9/00* (2006.01)

(52) U.S. Cl. ..... 417/153; 417/228; 417/366; 417/367

(58) Field of Classification Search ..... 417/153, 417/228, 366, 367
See application file for complete search history.

(56) References Cited

U.S. PATENT DOCUMENTS

| | | | | |
|---|---|---|---|---|
| 2,439,689 | A | 4/1948 | Hyde | 117/124 |
| 2,617,719 | A | 11/1952 | Stewart | 23/312 |
| 2,625,886 | A | 1/1953 | Browne | 103/150 |
| 3,642,020 | A | 2/1972 | Payne | 137/112 |
| 3,744,660 | A | 7/1973 | Gaines et al. | 220/10 |
| 3,890,176 | A | 6/1975 | Bolon | 156/2 |
| 3,900,551 | A | 8/1975 | Bardoncelli et al. | 423/9 |
| 3,968,885 | A | 7/1976 | Hassan et al. | 214/1 BC |
| 4,029,517 | A | 6/1977 | Rand | 134/11 |
| 4,091,643 | A | 5/1978 | Zucchini | 68/18 C |
| 4,219,333 | A | 8/1980 | Harris | 8/137 |

(Continued)

FOREIGN PATENT DOCUMENTS

| | | |
|---|---|---|
| CH | SE 251213 | 8/1948 |

(Continued)

OTHER PUBLICATIONS

J. B. Rubin et al., *A Comparison of Chilled Dl Water/Ozone and $CO_2$-based Supercritical Fluids as Replacements for Photoresist-Stripping Solvents*, IEEE/CPMT Int'l Electronics Manufacturing Technology Symposium, pp. 308-314, 1998.

(Continued)

*Primary Examiner*—William H Rodriguez
*Assistant Examiner*—Patrick Hamo
(74) *Attorney, Agent, or Firm*—Wood, Herron & Evans, LLP

(57) ABSTRACT

A processing system utilizing a supercritical fluid for treating a substrate is described as having a pump for recirculating the supercritical fluid over the substrate. For various applications in supercritical fluid processing, the fluid temperature for the treatment process can elevate above the temperature acceptable for safe operation of the pump. Therefore, in accordance with one embodiment, a fraction of supercritical fluid from the primary recirculating flow of supercritical fluid over the substrate is circulated from the pressure side of the pump, through a heat exchanger to lower the temperature of the supercritical fluid, through the pump, and it is returned to the primary flow on the suction side of the pump. In accordance with yet another embodiment, supercritical fluid is circulated through the pump from an independent source to vent.

14 Claims, 6 Drawing Sheets

U.S. PATENT DOCUMENTS

| | | | | |
|---|---|---|---|---|
| 4,245,154 | A | 1/1981 | Uehara et al. | 250/227 |
| 4,341,592 | A | 7/1982 | Shortes et al. | 156/643 |
| 4,349,415 | A | 9/1982 | DeFilippi et al. | 204/14 |
| 4,355,937 | A | 10/1982 | Mack et al. | 414/217 |
| 4,367,140 | A | 1/1983 | Wilson | 210/110 |
| 4,406,596 | A | 9/1983 | Budde | 417/393 |
| 4,422,651 | A | 12/1983 | Platts | 277/206 R |
| 4,474,199 | A | 10/1984 | Blaudszun | 134/105 |
| 4,475,993 | A | 10/1984 | Blander et al. | 204/64 |
| 4,522,788 | A | 6/1985 | Sitek et al. | 422/78 |
| 4,549,467 | A | 10/1985 | Wilden et al. | 91/307 |
| 4,592,306 | A | 6/1986 | Gallego | 118/719 |
| 4,601,181 | A | 7/1986 | Privat | 68/18 C |
| 4,626,509 | A | 12/1986 | Lyman | 435/287 |
| 4,670,126 | A | 6/1987 | Messer et al. | 204/298 |
| 4,682,937 | A | 7/1987 | Credle, Jr. | 417/393 |
| 4,693,777 | A | 9/1987 | Hazano et al. | 156/345 |
| 4,749,440 | A | 6/1988 | Blackwood et al. | 156/646 |
| 4,778,356 | A | 10/1988 | Hicks | 417/397 |
| 4,788,043 | A | 11/1988 | Kagiyama et al. | 422/292 |
| 4,789,077 | A | 12/1988 | Noe | 220/319 |
| 4,823,976 | A | 4/1989 | White, III et al. | 220/211 |
| 4,825,808 | A | 5/1989 | Takahashi et al. | 118/719 |
| 4,827,867 | A | 5/1989 | Takei et al. | 118/64 |
| 4,838,476 | A | 6/1989 | Rahn | 228/180.1 |
| 4,865,061 | A | 9/1989 | Fowler et al. | 134/108 |
| 4,877,530 | A | 10/1989 | Moses | 210/511 |
| 4,879,004 | A | 11/1989 | Oesch et al. | 203/89 |
| 4,879,431 | A | 11/1989 | Bertoncini | 435/311 |
| 4,917,556 | A | 4/1990 | Stark et al. | 414/217 |
| 4,923,828 | A | 5/1990 | Gluck et al. | 437/225 |
| 4,924,892 | A | 5/1990 | Kiba et al. | 134/123 |
| 4,925,790 | A | 5/1990 | Blanch et al. | 435/52 |
| 4,933,404 | A | 6/1990 | Beckman et al. | 526/207 |
| 4,944,837 | A | 7/1990 | Nishikawa et al. | 156/646 |
| 4,951,601 | A | 8/1990 | Maydan et al. | 118/719 |
| 4,960,140 | A | 10/1990 | Ishijima et al. | 134/31 |
| 4,983,223 | A | 1/1991 | Gessner | 134/25.4 |
| 5,011,542 | A | 4/1991 | Weil | 134/38 |
| 5,013,366 | A | 5/1991 | Jackson et al. | 134/1 |
| 5,044,871 | A | 9/1991 | Davis et al. | 414/786 |
| 5,062,770 | A | 11/1991 | Story et al. | 417/46 |
| 5,068,040 | A | 11/1991 | Jackson | 210/748 |
| 5,071,485 | A | 12/1991 | Matthews et al. | 134/2 |
| 5,091,207 | A | 2/1992 | Tanaka | 427/8 |
| 5,105,556 | A | 4/1992 | Kurokawa et al. | 34/12 |
| 5,143,103 | A | 9/1992 | Basso et al. | 134/98.1 |
| 5,158,704 | A | 10/1992 | Fulton et al. | 252/309 |
| 5,167,716 | A | 12/1992 | Boitnott et al. | 118/719 |
| 5,169,296 | A | 12/1992 | Wilden | 417/395 |
| 5,169,408 | A | 12/1992 | Biggerstaff et al. | 29/25.01 |
| 5,174,917 | A | 12/1992 | Monzyk | 252/60 |
| 5,185,058 | A | 2/1993 | Cathey, Jr. | 156/656 |
| 5,185,296 | A | 2/1993 | Morita et al. | 437/229 |
| 5,186,594 | A | 2/1993 | Toshima et al. | 414/217 |
| 5,186,718 | A | 2/1993 | Tepman et al. | 29/25.01 |
| 5,188,515 | A | 2/1993 | Horn | 417/63 |
| 5,190,373 | A | 3/1993 | Dickson et al. | 366/146 |
| 5,191,993 | A | 3/1993 | Wanger et al. | 220/333 |
| 5,193,560 | A | 3/1993 | Tanaka et al. | 134/56 R |
| 5,195,878 | A | 3/1993 | Sahiavo et al. | 417/393 |
| 5,196,134 | A | 3/1993 | Jackson | 252/103 |
| 5,201,960 | A | 4/1993 | Starov | 134/11 |
| 5,213,485 | A | 5/1993 | Wilden | 417/393 |
| 5,213,619 | A | 5/1993 | Jackson et al. | 134/1 |
| 5,215,592 | A | 6/1993 | Jackson | 134/1 |
| 5,217,043 | A | 6/1993 | Novakovi | 137/460 |
| 5,221,019 | A | 6/1993 | Pechacek et al. | 220/315 |
| 5,222,876 | A | 6/1993 | Budde | 417/393 |
| 5,224,504 | A | 7/1993 | Thompson et al. | 134/155 |
| 5,225,173 | A | 7/1993 | Wai | 423/2 |
| 5,236,602 | A | 8/1993 | Jackson | 210/748 |
| 5,236,669 | A | 8/1993 | Simmons et al. | 422/113 |
| 5,237,824 | A | 8/1993 | Pawliszyn | 62/51.1 |
| 5,238,671 | A | 8/1993 | Matson et al. | 423/397 |
| 5,240,390 | A | 8/1993 | Kvinge et al. | 417/393 |
| 5,243,821 | A | 9/1993 | Schuck et al. | 62/50.6 |
| 5,246,500 | A | 9/1993 | Samata et al. | 118/719 |
| 5,250,078 | A | 10/1993 | Saus et al. | 8/475 |
| 5,251,776 | A | 10/1993 | Morgan, Jr. et al. | 220/360 |
| 5,261,965 | A | 11/1993 | Moslehi | 134/1 |
| 5,266,205 | A | 11/1993 | Fulton et al. | 210/639 |
| 5,267,455 | A | 12/1993 | Dewees et al. | 68/5 C |
| 5,269,815 | A | 12/1993 | Schlenker et al. | 8/475 |
| 5,269,850 | A | 12/1993 | Jackson | 134/2 |
| 5,270,948 | A | 12/1993 | Sato et al. | 430/314 |
| 5,274,129 | A | 12/1993 | Natale et al. | 549/349 |
| 5,280,693 | A | 1/1994 | Heudecker | 53/306 |
| 5,285,352 | A | 2/1994 | Pastore et al. | 361/707 |
| 5,288,333 | A | 2/1994 | Tanaka et al. | 134/31 |
| 5,290,361 | A | 3/1994 | Hayashida et al. | 134/2 |
| 5,294,261 | A | 3/1994 | McDermott et al. | 134/7 |
| 5,298,032 | A | 3/1994 | Schlenker et al. | 8/475 |
| 5,304,515 | A | 4/1994 | Morita et al. | 437/231 |
| 5,306,350 | A | 4/1994 | Hoy et al. | 134/22.14 |
| 5,312,882 | A | 5/1994 | DeSimone et al. | 526/201 |
| 5,313,965 | A | 5/1994 | Palen | 134/61 |
| 5,314,574 | A | 5/1994 | Takahashi | 156/646 |
| 5,316,591 | A | 5/1994 | Chao et al. | 134/34 |
| 5,320,742 | A | 6/1994 | Fletcher et al. | 208/89 |
| 5,328,722 | A | 7/1994 | Ghanayem et al. | 427/250 |
| 5,334,332 | A | 8/1994 | Lee | 252/548 |
| 5,334,493 | A | 8/1994 | Fujita et al. | 430/463 |
| 5,337,446 | A | 8/1994 | Smith et al. | 15/21.1 |
| 5,339,844 | A | 8/1994 | Stanford, Jr. et al. | 134/107 |
| 5,352,327 | A | 10/1994 | Witowski | 156/646 |
| 5,355,901 | A | 10/1994 | Mielnik et al. | 134/105 |
| 5,356,538 | A | 10/1994 | Wai et al. | 210/634 |
| 5,364,497 | A | 11/1994 | Chau et al. | 156/645 |
| 5,368,171 | A | 11/1994 | Jackson | 134/147 |
| 5,370,740 | A | 12/1994 | Chao et al. | 134/1 |
| 5,370,741 | A | 12/1994 | Bergman | 134/3 |
| 5,370,742 | A | 12/1994 | Mitchell et al. | 134/10 |
| 5,377,705 | A | 1/1995 | Smith, Jr. et al. | 134/95.3 |
| 5,401,322 | A | 3/1995 | Marshall | 134/13 |
| 5,403,621 | A | 4/1995 | Jackson et al. | 427/255.1 |
| 5,403,665 | A | 4/1995 | Alley et al. | 428/447 |
| 5,404,894 | A | 4/1995 | Shiraiwa | 134/66 |
| 5,412,958 | A | 5/1995 | Iliff et al. | 68/5 C |
| 5,417,768 | A | 5/1995 | Smith, Jr. et al. | 134/10 |
| 5,433,334 | A | 7/1995 | Reneau | 220/319 |
| 5,447,294 | A | 9/1995 | Sakata et al. | 266/257 |
| 5,456,759 | A | 10/1995 | Stanford, Jr. et al. | 134/1 |
| 5,470,393 | A | 11/1995 | Fukazawa | 134/3 |
| 5,474,812 | A | 12/1995 | Truckenmuller et al. | 427/430.1 |
| 5,482,564 | A | 1/1996 | Douglas et al. | 134/18 |
| 5,486,212 | A | 1/1996 | Mitchell et al. | 8/142 |
| 5,494,526 | A | 2/1996 | Paranjpe | 134/1 |
| 5,500,081 | A | 3/1996 | Bergman | 156/646.1 |
| 5,501,761 | A | 3/1996 | Evans et al. | 156/344 |
| 5,503,176 | A | 4/1996 | Dummire et al. | 137/15 |
| 5,505,219 | A | 4/1996 | Lansberry et al. | 134/105 |
| 5,509,431 | A | 4/1996 | Smith, Jr. et al. | 134/95.1 |
| 5,514,220 | A | 5/1996 | Wetmore et al. | 134/22.18 |
| 5,522,938 | A | 6/1996 | O'Brien | 134/1 |
| 5,526,834 | A | 6/1996 | Mielnik et al. | 134/105 |
| 5,533,538 | A | 7/1996 | Marshall | 134/104.4 |
| 5,547,774 | A | 8/1996 | Gimzewski et al. | 428/694 |
| 5,550,211 | A | 8/1996 | DeCrosta et al. | 528/489 |
| 5,571,330 | A | 11/1996 | Kyogoku | 118/719 |
| 5,580,846 | A | 12/1996 | Hayashida et al. | 510/175 |
| 5,589,082 | A | 12/1996 | Lin et al. | 216/2 |
| 5,589,105 | A | 12/1996 | DeSimone et al. | 252/351 |
| 5,589,224 | A | 12/1996 | Tepman et al. | 427/248.1 |

5,618,751 A 4/1997 Golden et al. ..... 438/392
5,621,982 A 4/1997 Yamashita et al. ..... 34/203
5,629,918 A 5/1997 Ho et al. ..... 369/112
5,632,847 A 5/1997 Ohno et al. ..... 156/344
5,635,463 A 6/1997 Muraoka ..... 510/175
5,637,151 A 6/1997 Schulz ..... 134/2
5,641,887 A 6/1997 Beckman et al. ..... 546/26.2
5,644,855 A 7/1997 McDermott et al. ..... 34/516
5,649,809 A 7/1997 Stapelfeldt ..... 417/63
5,656,097 A 8/1997 Olesen et al. ..... 134/1
5,665,527 A 9/1997 Allen et al. ..... 430/325
5,669,251 A 9/1997 Townsend et al. ..... 68/58
5,672,204 A 9/1997 Habuka ..... 117/204
5,676,705 A 10/1997 Jureller et al. ..... 8/142
5,679,169 A 10/1997 Gonzales et al. ..... 134/1.3
5,679,171 A 10/1997 Saga et al. ..... 134/3
5,683,473 A 11/1997 Jureller et al. ..... 8/142
5,683,977 A 11/1997 Jureller et al. ..... 510/286
5,688,879 A 11/1997 DeSimone ..... 526/89
5,700,379 A 12/1997 Biebl ..... 216/2
5,702,228 A 12/1997 Tamai et al. ..... 414/744.5
5,706,319 A 1/1998 Holtz ..... 376/203
5,714,299 A 2/1998 Combes et al. ..... 430/137
5,725,987 A 3/1998 Combes et al. ..... 430/137
5,726,211 A 3/1998 Hedrick et al. ..... 521/61
5,730,874 A 3/1998 Wai et al. ..... 210/638
5,736,425 A 4/1998 Smith et al. ..... 438/778
5,739,223 A 4/1998 DeSimone ..... 526/89
5,746,008 A 5/1998 Yamashita et al. ..... 34/211
5,766,367 A 6/1998 Smith et al. ..... 134/2
5,769,588 A 6/1998 Toshima et al. ..... 414/217
5,783,082 A 7/1998 DeSimone et al. ..... 210/634
5,797,719 A 8/1998 James et al. ..... 417/46
5,798,126 A 8/1998 Fujikawa et al. ..... 425/78
5,798,438 A 8/1998 Sawan et al. ..... 528/483
5,804,607 A 9/1998 Hedrick et al. ..... 521/64
5,807,607 A 9/1998 Smith et al. ..... 427/96
5,817,178 A 10/1998 Mita et al. ..... 118/666
5,847,443 A 12/1998 Cho et al. ..... 257/632
5,866,005 A 2/1999 DeSimone et al. ..... 210/634
5,868,856 A 2/1999 Douglas et al. ..... 134/2
5,868,862 A 2/1999 Douglas et al. ..... 134/26
5,872,061 A 2/1999 Lee et al. ..... 438/705
5,872,257 A 2/1999 Beckman et al. ..... 546/336
5,873,948 A 2/1999 Kim ..... 134/19
5,881,577 A 3/1999 Sauer et al. ..... 68/5
5,882,165 A 3/1999 Maydan et al. ..... 414/217
5,888,050 A 3/1999 Fitzgerald et al. ..... 417/46
5,893,756 A 4/1999 Berman et al. ..... 438/692
5,896,870 A 4/1999 Huynh et al. ..... 134/1.3
5,898,727 A 4/1999 Fujikawa et al. ..... 373/110
5,900,107 A 5/1999 Murphy et al. ..... 156/359
5,900,354 A 5/1999 Batchelder ..... 430/395
5,904,737 A 5/1999 Preston et al. ..... 8/158
5,906,866 A 5/1999 Webb ..... 427/534
5,908,510 A 6/1999 McCullough et al. ..... 134/2
5,928,389 A 7/1999 Jevtic ..... 29/25.01
5,932,100 A 8/1999 Yager et al. ..... 210/634
5,934,856 A 8/1999 Asakawa et al. ..... 414/217
5,934,991 A 8/1999 Rush ..... 454/187
5,944,996 A 8/1999 DeSimone et al. ..... 210/634
5,955,140 A 9/1999 Smith et al. ..... 427/96
5,965,025 A 10/1999 Wai et al. ..... 210/634
5,975,492 A 11/1999 Brenes ..... 251/175
5,976,264 A 11/1999 McCullough et al. ..... 134/2
5,979,306 A 11/1999 Fujikawa et al. ..... 100/90
5,980,648 A 11/1999 Adler ..... 134/34
5,981,399 A 11/1999 Kawamura et al. ..... 438/715
5,989,342 A 11/1999 Ikede et al. ..... 118/52
5,992,680 A 11/1999 Smith ..... 220/812
5,994,696 A 11/1999 Tai et al. ..... 250/288
6,005,226 A 12/1999 Aschner et al. ..... 219/390
6,017,820 A 1/2000 Ting et al. ..... 438/689
6,021,791 A 2/2000 Dryer et al. ..... 134/100.1
6,024,801 A 2/2000 Wallace et al. ..... 134/1
6,029,371 A 2/2000 Kamikawa et al. ..... 34/516
6,035,871 A 3/2000 Eui-Yeol ..... 134/61
6,037,277 A 3/2000 Masakara et al. ..... 438/787
6,053,348 A 4/2000 Morch ..... 220/683
6,056,008 A 5/2000 Adams et al. ..... 137/487.5
6,063,714 A 5/2000 Smith et al. ..... 438/778
6,067,728 A 5/2000 Farmer et al. ..... 34/470
6,077,053 A 6/2000 Fujikawa et al. ..... 417/399
6,077,321 A 6/2000 Adachi et al. ..... 29/25.01
6,082,150 A 7/2000 Stucker ..... 68/18 R
6,085,935 A 7/2000 Malchow et al. ..... 220/813
6,097,015 A 8/2000 McCullough et al. ..... 219/686
6,099,619 A 8/2000 Lansbarkis et al. ..... 95/118
6,100,198 A 8/2000 Grieger et al. ..... 438/692
6,110,232 A 8/2000 Chen et al. ..... 29/25.01
6,114,044 A 9/2000 Houston et al. ..... 428/447
6,122,566 A 9/2000 Nguyen et al. ..... 700/218
6,128,830 A 10/2000 Bettcher et al. ..... 34/404
6,140,252 A 10/2000 Cho et al. ..... 438/781
6,145,519 A 11/2000 Konishi et al. ..... 134/95.2
6,149,828 A 11/2000 Vaartstra ..... 216/57
6,159,295 A 12/2000 Maskara et al. ..... 118/688
6,164,297 A 12/2000 Kamikawa ..... 134/61
6,171,645 B1 1/2001 Smith et al. ..... 427/96
6,186,722 B1 2/2001 Shirai ..... 414/217
6,200,943 B1 3/2001 Romack et al. ..... 510/285
6,203,582 B1 3/2001 Berner et al. ..... 29/25.01
6,216,364 B1 4/2001 Tanaka et al. ..... 34/448
6,224,774 B1 5/2001 DeSimone et al. ..... 210/634
6,228,563 B1 5/2001 Starov et al. ..... 430/327
6,228,826 B1 5/2001 DeYoung et al. ..... 510/291
6,232,238 B1 5/2001 Chang et al. ..... 438/725
6,232,417 B1 5/2001 Rhodes et al. ..... 526/171
6,235,634 B1 5/2001 White et al. ..... 438/680
6,239,038 B1 5/2001 Wen ..... 438/745
6,241,825 B1 6/2001 Wytman ..... 118/733
6,242,165 B1 6/2001 Vaartstra ..... 430/329
6,244,121 B1 6/2001 Hunter ..... 73/865.9
6,251,250 B1 6/2001 Keigler ..... 205/89
6,255,732 B1 7/2001 Yokoyama et al. ..... 257/760
6,270,531 B1 8/2001 DeYoung et al. ..... 8/142
6,277,753 B1 8/2001 Mullee et al. ..... 438/692
6,284,558 B1 9/2001 Sakamoto ..... 438/30
6,286,231 B1 9/2001 Bergman et al. ..... 34/410
6,305,677 B1 10/2001 Lenz ..... 269/13
6,306,564 B1 10/2001 Mullee ..... 430/329
6,319,858 B1 11/2001 Lee et al. ..... 438/787
6,331,487 B2 12/2001 Koch ..... 438/692
6,334,266 B1 1/2002 Moritz et al. ..... 34/337
6,344,174 B1 2/2002 Miller et al. ..... 422/98
6,344,243 B1 2/2002 McClain et al. ..... 427/388.1
6,355,072 B1 3/2002 Racette et al. ..... 8/142
6,358,673 B1 3/2002 Namatsu ..... 430/311
6,361,696 B1 3/2002 Spiegelman et al. ..... 210/662
6,367,491 B1 4/2002 Marshall et al. ..... 134/104.4
6,380,105 B1 4/2002 Smith et al. ..... 438/778
6,388,317 B1 5/2002 Reese ..... 257/713
6,389,677 B1 5/2002 Lenz ..... 29/559
6,418,956 B1 7/2002 Bloom ..... 137/14
6,425,956 B1 7/2002 Cotte et al. ..... 134/3
6,436,824 B1 8/2002 Chooi et al. ..... 438/687
6,451,510 B1 9/2002 Messick et al. ..... 430/311
6,454,519 B1 9/2002 Toshima et al. ..... 414/805
6,454,945 B1 9/2002 Weigl et al. ..... 210/634
6,458,494 B2 10/2002 Song et al. ..... 430/5
6,461,967 B2 10/2002 Wu et al. ..... 438/705
6,464,790 B1 10/2002 Sherstinsky et al. ..... 118/715
6,465,403 B1 10/2002 Skee ..... 510/175
6,472,334 B2 10/2002 Ikakura et al. ..... 438/778
6,478,035 B1 11/2002 Niuya et al.
6,479,407 B2 11/2002 Yokoyama et al. ..... 438/788

| | | | | |
|---|---|---|---|---|
| 6,485,895 | B1 | 11/2002 | Choi et al. | 430/330 |
| 6,486,078 | B1 | 11/2002 | Rangarajan et al. | 438/778 |
| 6,487,792 | B2 | 12/2002 | Sutton et al. | |
| 6,487,994 | B2 | 12/2002 | Ahern et al. | |
| 6,492,090 | B2 | 12/2002 | Nishi et al. | 430/270.1 |
| 6,500,605 | B1 | 12/2002 | Mullee et al. | 430/329 |
| 6,503,837 | B2 | 1/2003 | Chiou | 438/691 |
| 6,508,259 | B1 | 1/2003 | Tseronis et al. | 134/105 |
| 6,509,136 | B1 | 1/2003 | Goldfarb et al. | 430/272.1 |
| 6,509,141 | B2 | 1/2003 | Mullee | 430/329 |
| 6,520,767 | B1 | 2/2003 | Ahern et al. | |
| 6,521,466 | B1 | 2/2003 | Castrucci | 438/5 |
| 6,537,916 | B2 | 3/2003 | Mullee et al. | 438/692 |
| 6,541,278 | B2 | 4/2003 | Morita et al. | 438/3 |
| 6,546,946 | B2 | 4/2003 | Dunmire | 137/15.18 |
| 6,550,484 | B1 | 4/2003 | Gopinath et al. | 134/1.2 |
| 6,554,507 | B2 | 4/2003 | Namatsu | 396/611 |
| 6,558,475 | B1 | 5/2003 | Jur et al. | 134/21 |
| 6,561,213 | B2 | 5/2003 | Wang et al. | 137/263 |
| 6,561,220 | B2 | 5/2003 | McCullough et al. | 137/565.12 |
| 6,561,481 | B1 | 5/2003 | Filonczuk | 251/129.12 |
| 6,561,767 | B2 | 5/2003 | Berger et al. | 417/53 |
| 6,561,774 | B2 | 5/2003 | Layman | |
| 6,562,146 | B1 | 5/2003 | DeYoung et al. | 134/30 |
| 6,564,826 | B2 | 5/2003 | Shen | 137/505.18 |
| 6,576,138 | B2 | 6/2003 | Sateria et al. | 210/664 |
| 6,583,067 | B2 | 6/2003 | Chang et al. | 438/723 |
| 6,596,093 | B2 | 7/2003 | DeYoung et al. | 134/36 |
| 6,613,157 | B2 | 9/2003 | DeYoung et al. | 134/36 |
| 6,623,355 | B2 | 9/2003 | McClain et al. | 457/60 |
| 6,635,565 | B2 | 10/2003 | Wu et al. | 438/637 |
| 6,635,582 | B2 | 10/2003 | Yun et al. | 438/745 |
| 6,641,678 | B2 | 11/2003 | DeYoung et al. | 134/36 |
| 6,656,666 | B2 | 12/2003 | Simons et al. | 430/322 |
| 6,669,916 | B2 | 12/2003 | Heim et al. | 423/245.1 |
| 6,673,521 | B2 | 1/2004 | Moreau et al. | 430/315 |
| 6,677,244 | B2 | 1/2004 | Ono et al. | 438/706 |
| 6,685,903 | B2 | 2/2004 | Wong et al. | 423/262 |
| 6,715,498 | B1 | 4/2004 | Humayun et al. | |
| 6,722,642 | B1 | 4/2004 | Sutton et al. | |
| 6,736,149 | B2 | 5/2004 | Biberger et al. | |
| 6,737,725 | B2 | 5/2004 | Grill et al. | 257/522 |
| 6,748,960 | B1 | 6/2004 | Biberger et al. | |
| 6,764,552 | B1 * | 7/2004 | Joyce et al. | 134/3 |
| 6,777,312 | B2 | 8/2004 | Yang et al. | 438/464 |
| 6,780,765 | B2 | 8/2004 | Goldstein | 438/660 |
| 6,800,142 | B1 | 10/2004 | Tipton et al. | |
| 6,802,961 | B2 | 10/2004 | Jackson | 210/86 |
| 6,852,194 | B2 | 2/2005 | Matsushita et al. | |
| 6,871,512 | B2 * | 3/2005 | Tsunoda | 62/505 |
| 6,871,656 | B2 | 3/2005 | Mullee | |
| 6,890,853 | B2 | 5/2005 | Biberger et al. | |
| 6,921,456 | B2 | 7/2005 | Biberger et al. | |
| 6,924,086 | B1 | 8/2005 | Arena-Foster et al. | |
| 6,926,012 | B2 | 8/2005 | Biberger et al. | |
| 6,926,798 | B2 | 8/2005 | Biberger et al. | |
| 6,928,746 | B2 | 8/2005 | Arena-Foster et al. | |
| 6,953,654 | B2 | 10/2005 | Ryza et al. | |
| 2002/0001929 | A1 | 1/2002 | Biberger et al. | 438/584 |
| 2002/0117391 | A1 | 8/2002 | Beam | 203/81 |
| 2003/0003762 | A1 | 1/2003 | Cotte et al. | 438/745 |
| 2003/0013311 | A1 | 1/2003 | Chang et al. | 438/704 |
| 2003/0036023 | A1 | 2/2003 | Moreau et al. | 430/324 |
| 2003/0047533 | A1 | 3/2003 | Reid et al. | 216/24 |
| 2003/0106573 | A1 | 6/2003 | Masuda et al. | 134/26 |
| 2003/0125225 | A1 | 7/2003 | Xu et al. | 510/175 |
| 2003/0196679 | A1 | 10/2003 | Cotte et al. | 134/1 |
| 2003/0198895 | A1 | 10/2003 | Toma et al. | |
| 2003/0202792 | A1 | 10/2003 | Goshi | |
| 2004/0011386 | A1 | 1/2004 | Seghal | |
| 2004/0020518 | A1 | 2/2004 | DeYoung et al. | 134/30 |
| 2004/0045588 | A1 | 3/2004 | DeYoung et al. | 134/26 |
| 2004/0050406 | A1 | 3/2004 | Sehgal | |
| 2004/0087457 | A1 | 5/2004 | Korzenski et al. | 510/177 |
| 2004/0103922 | A1 | 6/2004 | Inoue et al. | 134/26 |
| 2004/0112409 | A1 | 6/2004 | Schilling | 134/26 |
| 2004/0134515 | A1 | 7/2004 | Castrucci | 134/2 |
| 2004/0177867 | A1 | 9/2004 | Schilling | 134/26 |
| 2004/0259357 | A1 | 12/2004 | Saga | |
| 2004/0261710 | A1 | 12/2004 | Matsushita et al. | |
| 2005/0077597 | A1 | 4/2005 | Toma et al. | |
| 2005/0158477 | A1 | 7/2005 | Vezin et al. | |
| 2005/0203789 | A1 | 9/2005 | Kauffman et al. | |
| 2005/0215072 | A1 | 9/2005 | Kevwitch et al. | |
| 2005/0216228 | A1 | 9/2005 | Kauffman et al. | |
| 2006/0003592 | A1 | 1/2006 | Gale et al. | |
| 2006/0102590 | A1 | 5/2006 | Kevwitch et al. | |
| 2006/0180573 | A1 | 8/2006 | Hansen et al. | |

FOREIGN PATENT DOCUMENTS

| | | | |
|---|---|---|---|
| CN | 1399790 | A | 2/2003 |
| DE | 36 08 783 | A1 | 9/1987 |
| DE | 39 04 514 | C2 | 3/1990 |
| DE | 40 04 111 | C2 | 8/1990 |
| DE | 39 06 724 | C2 | 9/1990 |
| DE | 39 06 735 | C2 | 9/1990 |
| DE | 39 06 737 | A1 | 9/1990 |
| DE | 44 29 470 | A1 | 3/1995 |
| DE | 43 44 021 | A1 | 6/1995 |
| DE | 198 60 084 | A1 | 7/2000 |
| EP | 0 244 951 | A2 | 11/1987 |
| EP | 02 72 141 | A2 | 6/1988 |
| EP | 0 283 740 | A2 | 9/1988 |
| EP | 0 302 345 | A2 | 2/1989 |
| EP | 0 370 233 | A1 | 5/1990 |
| EP | 0 391 035 | A2 | 10/1990 |
| EP | 0 453 867 | A1 | 10/1991 |
| EP | 0 518 653 | B1 | 12/1992 |
| EP | 0 536 752 | A2 | 4/1993 |
| EP | 0 572 913 | A1 | 12/1993 |
| EP | 0 587 168 | A1 | 3/1994 |
| EP | 0 620 270 | A3 | 10/1994 |
| EP | 0 679 753 | B1 | 11/1995 |
| EP | 0 711 864 | B1 | 5/1996 |
| EP | 0 726 099 | A2 | 8/1996 |
| EP | 0 727 711 | A2 | 8/1996 |
| EP | 0 822 583 | A2 | 2/1998 |
| EP | 0 829 312 | A2 | 3/1998 |
| EP | 0 836 895 | A2 | 4/1998 |
| EP | 0 903 775 | A2 | 3/1999 |
| FR | 1 499 491 | | 9/1967 |
| GB | 2 003 975 | | 3/1979 |
| GB | 2 193 482 | | 2/1988 |
| JP | 60-192333 | | 9/1985 |
| JP | 60-2348479 | | 11/1985 |
| JP | 60-246635 | | 12/1985 |
| JP | 61-017151 | | 1/1986 |
| JP | 61-231166 | | 10/1986 |
| JP | 62-111442 | | 5/1987 |
| JP | 62-125619 | | 6/1987 |
| JP | 63-256326 | | 10/1988 |
| JP | 63-303059 | | 12/1988 |
| JP | 1-045131 | | 2/1989 |
| JP | 1-246835 | | 10/1989 |
| JP | 2-148841 | | 6/1990 |
| JP | 2-209729 | | 8/1990 |
| JP | 2-304941 | | 12/1990 |
| JP | 4-284648 | | 10/1992 |
| JP | 7-142333 | | 6/1995 |
| JP | 8-186140 | A | 7/1996 |
| JP | 8-222508 | A | 8/1996 |
| JP | 10-144757 | A | 5/1998 |
| JP | 56-142629 | | 11/1998 |
| JP | 10335408 | A | 12/1998 |
| JP | 11-200035 | | 7/1999 |

| | | | |
|---|---|---|---|
| JP | 2000-106358 | | 4/2000 |
| KR | 2003000120 | A1 | 1/2003 |
| WO | WO 87/07309 | | 12/1987 |
| WO | WO 90/06189 | | 6/1990 |
| WO | WO 90/13675 | | 11/1990 |
| WO | WO 91/12629 | A | 8/1991 |
| WO | WO 93/14255 | | 7/1993 |
| WO | WO 93/14259 | | 7/1993 |
| WO | WO 93/20116 | | 10/1993 |
| WO | WO 96/27704 | | 9/1996 |
| WO | WO 99/18603 | A | 4/1999 |
| WO | WO 99/49998 | | 10/1999 |
| WO | WO 00/36635 | | 6/2000 |
| WO | WO 00/73241 | A1 | 12/2000 |
| WO | WO 01/10733 | A1 | 2/2001 |
| WO | WO 01/33613 | A2 | 5/2001 |
| WO | WO 01/33615 | A3 | 5/2001 |
| WO | WO 01/55628 | A1 | 8/2001 |
| WO | WO 01/68279 | A2 | 9/2001 |
| WO | WO 01/74538 | A1 | 10/2001 |
| WO | WO 01/78911 | A1 | 10/2001 |
| WO | WO 01/85391 | A2 | 11/2001 |
| WO | WO 01/94782 | A2 | 12/2001 |
| WO | WO 02/09894 | A2 | 2/2002 |
| WO | WO 02/11191 | A2 | 2/2002 |
| WO | WO 02/15251 | A1 | 2/2002 |
| WO | WO 02/16051 | A2 | 2/2002 |
| WO | WO03064065 | A1 | 8/2003 |
| WO | WO 03/030219 | A2 | 10/2003 |

OTHER PUBLICATIONS

*Los Alamos National Laboratory*, Solid State Technology, pp. S10 & S14, Oct. 1998.

*Supercritical Carbon Dioxide Resist Remover, SCORR, the Path to Least Photoresistance*, Los Alamos National Laboratory, 1998.

Z. Guan et al., *Fluorocarbon-Based Heterophase Polymeric Materials. I. Block Copolymer Surfactants for Carbon Dioxide Applications*, Macromolecules, vol. 27, pp. 5527-5532, 1994.

*International Journal of Environmentally Conscious Design& Manufacturing*, vol. 2, No. 1, pp. 83, 1993.

Matson and Smith , *Supercritical Fluids*, Journal of the American Ceramic Society, vol. 72, No. 6, pp. 872-874.

D.H. Ziger et al., *Compressed Fluid Technology: Application to RIE Developed Resists*, AIChE Journal, vol. 33, No. 10, pp. 1585-1591, Oct. 1987.

Kirk-Othmer, *Alcohol Fuels to Toxicology*, Encyclopedia of Chemical Terminology, 3rd ed., Supplement Volume, New York: John Wiley & Sons, pp. 872-893, 1984.

*Cleaning with Supercritical $CO_2$*, NASA Tech Briefs, MFS-29611, Marshall Space Flight Center, Alabama, Mar. 1979.

N. Basta, *Supercritical Fluids: Still Seeking Acceptance*, Chemical Engineering vol. 92, No. 3, pp. 14, Feb. 24, 1985.

D. Takahashi, *Los Alamos Lab Finds Way to Cut Chip Toxic Waste*, Wall Street Journal, Jun. 22, 1998.

*Supercritical $CO_2$ Process Offers Less Mess From Semiconductor Plants*, Chemical Engineering Magazine, pp. 27 & 29, Jul. 1988.

Y. P. Sun, *Preparation of Polymer Protected Semiconductor Nanoparticles Through the Rapid Expansion of Supercritical Fluid Solution*, Chemical Physics Letters, pp. 585-588, May 22, 1998.

K. Jackson et al., *Surfactants and Micromulsions in Supercritical Fluids*, Supercritical Fluid Cleaning, Noyes Publications, Westwood, NJ, pp. 87-120, Spring 1998.

M. Kryszewski, *Production of Metal and Semiconductor Nanoparticles in Polymer Systems*, Polimery, pp. 65-73, Feb. 1998.

G. L. Bakker et al., *Surface Cleaning and Carbonaceous Film Removal Using High Pressure, High Temperature Water, and Water/$CO_2$ Mixtures*, J Electrochem Soc., vol. 145, No. 1, pp. 284-291, Jan. 1998.

C. K. Ober et al., *Imaging Polymers with Supercritical Carbon Dioxide*, Advanced Materials, vol. 9, No. 13, pp. 1039-1043, Nov. 3, 1997.

E. M. Russick et al., *Supercritical Carbon Dioxide Extraction of Solvent from Micro-Machined Structures*, Supercritical Fluids Extraction and Pollution Prevention, ACS Symposium Series, vol. 670, pp. 255-269, Oct. 21, 1997.

N. Dahmen et al., *Supercritical Fluid Extraction of Grinding and Metal Cutting Waste Contaminated with Oils*, Supercritical Fluids—Extraction and Pollution Prevention, ACS Symposium Series, vol. 670, pp. 270-279, Oct. 21, 1997.

C. M. Wai, *Supercritical Fluid Extraction: Metals as Complexes*. Journal of Chromatography A, vol. 785, pp. 369-383, Oct. 17, 1997.

C. Xu et al., *Submicron-Sized Spherical Yttrium Oxide Based Phosphors Prepared by Supercritical $CO_2$ -Assisted Nerosolization and Pyrolysis*, Appl. Phys. Lett., vol. 71, No. 22, pp. 1643-1645, Sep. 22, 1997.

Y. Tomioka et al., *Decomposition of Tetramethylammonium (TMA) in a Positive Photo-resist Developer by Supercritical Water*, Abstracts of Papers 214th ACS Natl Meeting, American Chemcial Society, Abstract No. 108, Sep. 7, 1997.

H. Klein et al., *Cyclic Organic Carbonates Serve as Solvents and Reactive Diluents*Coatings World, pp. 38-40, May 1997.

J. Bühler et al., *Linear Array of Complementary Metal Oxide Semiconductor Double-Pass Metal Micro-mirrors*, Opt. Eng. vol. 36, No. 5, pp. 1391-1398, May 1997.

M. H. Jo et al., *Evaluation of $SiO_2$ Aerogel Thin Film with Ultra Low Dielectric Constant as an Intermetal Dielectric*, Microelectronic Engineering, vol. 33, pp. 343-348, Jan. 1997.

J. B. McClain et al., *Design of Nonionic Surfactants for Supercritical Carbon Dioxide* , Science, vol. 274, pp. 2049-2052, Dec. 20, 1996.

L. Znaidi et al., *Batch and Semi-Continuous Synthesis of Magnesium Oxide Powders from Hydrolysis and Supercritical Treatment of $Mg(OCH_3)_2$*, Materials Research Bulletin, vol. 31, No. 12, pp. 1527-1535, Dec. 1996.

M. E. Tadros, *Synthesis of Titanium Dioxide Particles in Supercritical $CO_2$*, J. Supercritical Fluids, vol. 9, pp. 172-176, Sep. 1996.

V. G. Courtecuisse et al., *Kinetics of the Titanium Isopropoxide Decomposition in Supercritical Isopropyl Alcohol*, Ind. Eng. Chem. Res., vol. 35, No. 8, pp. 2539-2545, Aug. 1996.

A Gabor et al., *Block and Random Copolymer Resists Designed for 193 nm Lithography and Environmentally Friendly Supercritical $CO_2$Development*, SPIE, vol. 2724, pp. 410-417, Jun. 1996.

G.L. Schimek et al., *Supercritical Ammonia Synthesis and Characterization of Four New Alkali Metal Silver Antimony Sulfides . . .* , J. Solid State Chemistry, vol. 123, pp. 277-284, May 1996.

P. Gallagher-Wetmore et al., *Supercritical Fluid Processing: Opportunities for New Resist Materials and Processes*, SPIE, vol. 2725, pp. 289-299, Apr. 1996.

K. I. Papathomas et al., *Debonding of Photoresists by Organic Solvents*, J. Applied Polymer Science, vol. 59, pp. 2029-2037, Mar. 28, 1996.

J. J. Watkins et al., *Polymer/Metal Nanocomposite Synthesis in Supercritical $CO_2$*, Chemistry of Materials, vol. 7, No. 11, pp. 1991-1994, Nov. 1995.

E. F. Gloyna et al., *Supercritical Water Oxidation Research and Development Update*, Environmental Progress, vol. 14, No. 3, pp. 182-192, Aug. 1995.

P. Gallagher-Wetmore et al., *Supercritical Fluid Processing: A New Dry Technique for Photoresist Developing*, SPIE, vol. 2438, pp. 694-708, Jun, 1995.

A.H. Gabor et al., *Silicon-Containing Block Copolymer Resist Materials*, Microelectronics Technology—Polymers for Advanced Imaging and Packaging, ACS Symposium Series, vol. 615, pp. 281-298, Apr. 1995.

P. C. Tsiartas et al., *Effect of Molecular Weight Distribution on the Dissolution Properties of Novolac Blends*, SPIE, vol. 2438, pp. 264-271, Jun. 1995.

R. D. Allen et al., *Performance Properties of Near-Monodisperse Novolak Resins*, SPIE, vol. 2438, pp. 250-260, Jun. 1995.

P. T. Wood et al., *Synthesis of New Channeled Structures in Supercritical Amines . . .* , Inorg. Chem., vol. 33, pp. 1556-1558, 1994.

J. B. Jerome et al., *Synthesis of New Low-Dimensional Quaternary Compounds . . .*, Inorg. Chem., vol. 33, pp. 1733-1734, 1994.

J. McHardy et al., *Progress in Supercritical $CO_2$ Cleaning*, SAMPE Jour, vol. 29, No. 5, pp. 20-27, Sep. 1993.
R. Purtell et al., *Precision Parts Cleaning Using Supercritical Fluids*, J. Vac. Sci. Technol. A., vol. 11, No. 4, pp. 1696-1701. Jul. 1993.
E. Bok et al., *Supercritical Fluids for Single Wafer Cleaning*, Solid State Technology, pp. 117-120, Jun. 1992.
T. Adschiri et al., *Rapid and Continuous Hydrothermal Crystallization of Metal Oxide Particles in Supercritical Water*, J. Am. Ceram. Cos., vol. 75, No. 4, pp. 1019-1022, 1992.
B. N. Hansen et al., *Supercritical Fluid Transport—Chemical Depostition of Films*, Chem. Mater, vol. 4, No. 4, pp. 749-752, 1992.
S. H. Page et al., *Predictability and Effect of Phase Behavior of $CO_2$/Propylene Carbonate in Supercritical Fluid Chromatography*, J. Microcol, vol. 3, No. 4, pp. 355-369, 1991.
T. Brokamp et al., *Synthese und Kristallstruktur Eines Gemischtvalenten Lithium-Tantalnitride $Li_2Ta_3N_5$*, J. Alloys and Compounds, vol. 176, pp. 47-60, 1991.
B. M. Hybertson et al., *Deposition of Palladium Films by a Novel Supercritical Transport Chemical Deposition Process*, Mat. Res. Bull., vol. 26, pp. 1127-1133, 1991.
D. H. Ziger et al., *Compressed Fluid Technology: Application to RIE Developed Resists*, AIChE Journal, vol. 33, No. 10, pp. 1585-1591, Oct. 1987.
D. W. Matson et al., *Rapid Expansion of Supercritical Fluid Solutions: Solute Formation of Powders, Thin Films, and Fibers*, Ind. Eng. Chem. Res., vol. 26, No. 11, pp. 2298-2306, 1987.
W. K. Tolley et al., *Stripping Organics from Metal and Mineral Surfaces Using Supercritical Fluids*, Separation Science and Technology, vol. 22, pp. 1087-1101, 1987.
*Final Report on the Safety Assessment of Propylene Carbonate*, J. American College of Toxicology, vol. 6, No. 1, pp. 23-51, 1987.
*Porous Xerogel Films as Ultra-Low Permittivity Dielectrics for ULSI Interconnect Applications*, Materials Research Society, pp. 463-469, 1987.
Kawakami et al., *A Super Low-k-(k=1.1) Silica Aerogel Film Using Supercritical Drying Technique*, IEEE, pp. 143-145, 2000.
R. F. Reidy, *Effects of Supercritical Processing on Ultra Low-k Films*, Texas Advanced Technology Program, Texas Instruments and the Texas Academy of Mathematics and Science.
Anthony Muscat, *Backend Processisng Using Supercritical $CO_2$*, University of Arizona.
D. Goldfarb et al., *Aqueous-based Photoresist Drying Using Supercritical Carbon Dioxide to Prevent Pattern Collapse*, J. Vacuum Sci. Tech. B, vol. 18, No. 6, pp. 3313, 2000.
H. Namatsu et al., *Supercritical Drying for Water-Rinsed Resist Systems*, J. Vacuum Sci. Tech. B, vol. 18, No. 6, pp. 3308, 2000.
N. Sundararajan et al., *Supercritical $CO_2$ Processing for Submicron Imaging of Fluoropolymers*, Chem. Mater., vol. 12, 41, 2000.
Hideaki Itakura et al., *Multi-Chamber Dry Etching System*, Solid State Technology, pp. 209-214, Apr. 1982.
Joseph L. Foszez, *Diaphragm Pumps Eliminate Seal Problems*, Plant Engineering, pp. 1-5, Feb. 1, 1996.
Bob Agnew, *Wilden Air-Operated Diaphragm Pumps*, Process & Industrial Training Technologies, Inc., 1996.
U.S. Patent and Trademark Office, Non-final Office Action in related U.S. Appl. No. 10/987,067, dated Dec. 21, 2006, 69 pgs.
U.S. Patent and Trademark Office, Non-final Office Action in related U.S. Appl. No. 10/906,349, dated Jan. 11, 2007, 62 pgs.
Jones et al., *HF Etchant Solutions in Supercritical Carbon Dioxide for "Dry" Etch Processing of Microelectronic Devices*, Chem Mater., vol. 15, 2003, pp. 2867-2869.
Gangopadhyay et al., *Supercritical $CO_2$ Treatments for Semiconductor Applications*, Mat. Res. Soc. Symp. Proc., vol. 812, 2004, pp. F4.6.1-F4.6.6.
European Patent Office, *International Search Report*, PCT/US2005/013885, Oct. 24, 2005, 4 pp.
European Patent Office, International Search Report and Written Opinion received in related PCT Application No. PCT/US2005/047409, dated Apr. 18, 2008, 14 pp.

* cited by examiner

METHOD AND SYSTEM FOR COOLING A PUMP

CROSS-REFERENCE TO RELATED APPLICATIONS

This application is related to co-pending U.S. patent application Ser. No. 10/987,067, entitled "Method and System for Treating a Substrate Using a Supercritical Fluid", filed on even date herewith. The entire content of this application is herein incorporated by reference in its entirety.

BACKGROUND OF THE INVENTION

1. Field of the Invention

The present invention relates to a system for treating a substrate using a supercritical fluid and, more particularly, to a system for flowing a high temperature supercritical fluid.

2. Description of Related Art

During the fabrication of semiconductor devices for integrated circuits (ICs), a sequence of material processing steps, including both pattern etching and deposition processes, are performed, whereby material is removed from or added to a substrate surface, respectively. During, for instance, pattern etching, a pattern formed in a mask layer of radiation-sensitive material, such as photoresist, using for example photolithography, is transferred to an underlying thin material film using a combination of physical and chemical processes to facilitate the selective removal of the underlying material film relative to the mask layer.

Thereafter, the remaining radiation-sensitive material, or photoresist, and post-etch residue, such as hardened photoresist and other etch residues, are removed using one or more cleaning processes. Conventionally, these residues are removed by performing plasma ashing in an oxygen plasma, followed by wet cleaning through immersion of the substrate in a liquid bath of stripper chemicals.

Until recently, dry plasma ashing and wet cleaning were found to be sufficient for removing residue and contaminants accumulated during semiconductor processing. However, recent advancements for ICs include a reduction in the critical dimension for etched features below a feature dimension acceptable for wet cleaning, such as a feature dimension below approximately 45 to 65 nanometers (nm). Moreover, the advent of new materials, such as low dielectric constant (low-k) materials, limits the use of plasma ashing due to their susceptibility to damage during plasma exposure.

Therefore, at present, interest has developed for the replacement of dry plasma ashing and wet cleaning. One interest includes the development of dry cleaning systems utilizing a supercritical fluid as a carrier for a solvent, or other residue removing composition. At present, the inventors have recognized that conventional processes are deficient in, for example, cleaning residue from a substrate, particularly those substrates following complex etching processes, or having high aspect ratio features.

SUMMARY OF THE INVENTION

The present invention provides a system for treating a substrate using a supercritical fluid. In one embodiment, the invention provides a fluid flow system for treating a substrate using a high temperature supercritical fluid, wherein the temperature of the supercritical fluid is equal to approximately 80° C. or greater.

According to another embodiment, the fluid flow system includes: a primary flow line coupled to a high pressure processing system and configured to supply supercritical fluid at a fluid temperature equal to or greater than 80° C. to the high pressure processing system; a high temperature pump coupled to the primary flow line and configured to move the supercritical fluid through the primary flow line to the high pressure processing system, wherein the high temperature pump comprises a coolant inlet configured to receive a coolant and a coolant outlet configured to discharge the coolant; and a heat exchanger coupled to the coolant inlet, and configured to lower a coolant temperature of the coolant to a temperature less than or equal to the fluid temperature of the supercritical fluid.

DETAILED DESCRIPTION OF EXEMPLARY EMBODIMENTS

In the following description, to facilitate a thorough understanding of the invention and for purposes of explanation and not limitation, specific details are set forth, such as a particular geometry of the processing system and various descriptions of the system components. However, it should be understood that the invention may be practiced with other embodiments that depart from these specific details.

Figure 1:
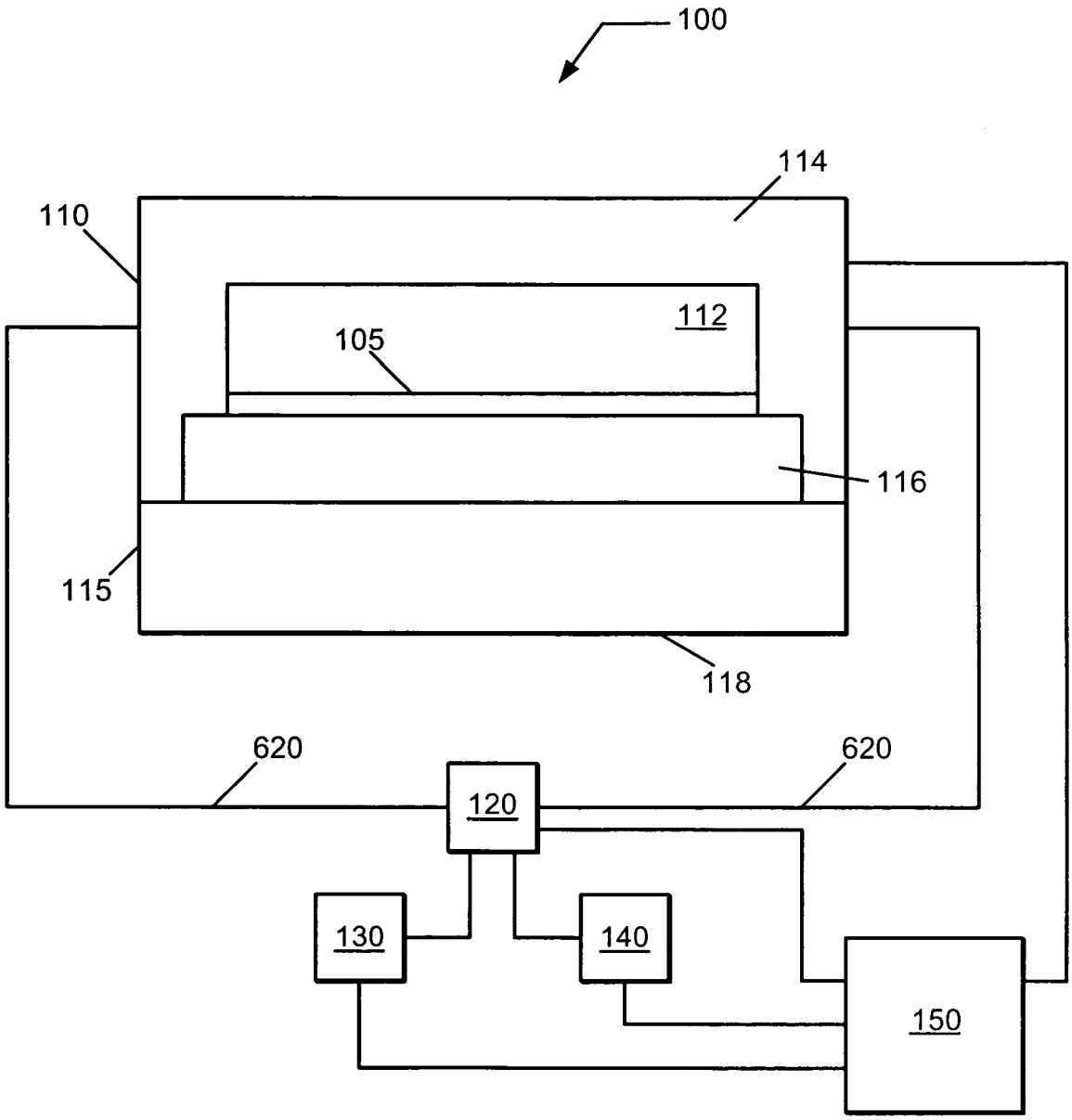
FIG. 1 presents a simplified schematic representation of a processing system.

Referring now to the drawings, wherein like reference numerals designate identical or corresponding parts throughout the several views, FIG. 1 illustrates a processing system 100 according to an embodiment of the invention. In the illustrated embodiment, processing system 100 is configured to treat a substrate 105 with a high pressure fluid, such as a fluid in a supercritical state, with or without other additives, such as process chemistry, at an elevated temperature above the fluid's critical temperature and greater than or equal to approximately 80° C. The processing system 100 comprises processing elements that include a processing chamber 110, a fluid flow system 120, a process chemistry supply system 130, a high pressure fluid supply system 140, and a controller 150, all of which are configured to process substrate 105. The controller 150 can be coupled to the processing chamber 110, the fluid flow system 120, the process chemistry supply system 130, and the high pressure fluid supply system 140. Alternately, or in addition, controller 150 can be coupled to a one or more additional controllers/computers (not shown), and controller 150 can obtain setup and/or configuration information from an additional controller/computer.

In FIG. 1, singular processing elements (110, 120, 130, 140, and 150) are shown, but this is not required for the invention. The processing system 100 can comprise any number of processing elements having any number of controllers associated with them in addition to independent processing elements.

The controller 150 can be used to configure any number of processing elements (110, 120, 130, and 140), and the controller 150 can collect, provide, process, store, and display data from processing elements. The controller 150 can comprise a number of applications for controlling one or more of the processing elements. For example, controller 150 can include a graphic user interface (GUI) component (not shown) that can provide easy to use interfaces that enable a user to monitor and/or control one or more processing elements.

Referring still to FIG. 1, the fluid flow system 120 is configured to flow fluid and chemistry from the supplies 130 and 140 through the processing chamber 110. The fluid flow system 120 is illustrated as a recirculation system through which the fluid and chemistry recirculate from and back to the processing chamber 110 via a primary flow line 620. This recirculation is most likely to be the preferred configuration for many applications, but this is not necessary to the invention. Fluids, particularly inexpensive fluids, can be passed through the processing chamber 110 once and then discarded, which might be more efficient than reconditioning them for re-entry into the processing chamber. Accordingly, while the fluid flow system is described as a recirculating system in the exemplary embodiments, a non-recirculating system may, in some cases, be substituted. This fluid flow system or recirculation system 120 can include one or more valves (not shown) for regulating the flow of a processing solution through the fluid flow system 120 and through the processing chamber 110. The fluid flow system 120 can comprise any number of back-flow valves, filters, pumps, and/or heaters (not shown) for maintaining a specified temperature, pressure or both for the processing solution and for flowing the process solution through the fluid flow system 120 and through the processing chamber 110. Furthermore, any one of the many components provided within the fluid flow system 120 may be heated to a temperature consistent with the specified process temperature.

Some components, such as a fluid flow or recirculation pump, may require cooling in order to permit proper functioning. For example, some commercially available pumps, having specifications required for processing performance at high pressure and cleanliness during supercritical processing, comprise components that are limited in temperature. Therefore, as the temperature of the fluid and structure are elevated, cooling of the pump is required to maintain its functionality. Fluid flow system 120 for circulating the supercritical fluid through high pressure processing system 100 can comprise a primary flow line 620 coupled to high pressure processing chamber 110, and configured to supply the supercritical fluid at a fluid temperature equal to or greater than 80° C. to the high pressure processing chamber 110, and a high temperature pump 600, shown and described below with reference to FIGS. 6A and 6B, coupled to the primary flow line 620. The high temperature pump can be configured to move the supercritical fluid through the primary flow line 620 to the high pressure processing chamber 110, wherein the high temperature pump comprises a coolant inlet configured to receive a coolant and a coolant outlet configured to discharge the coolant. A heat exchanger coupled to the coolant inlet can be configured to lower a coolant temperature of the coolant to a temperature less than or equal to the fluid temperature of the supercritical fluid.

Figure 6A:
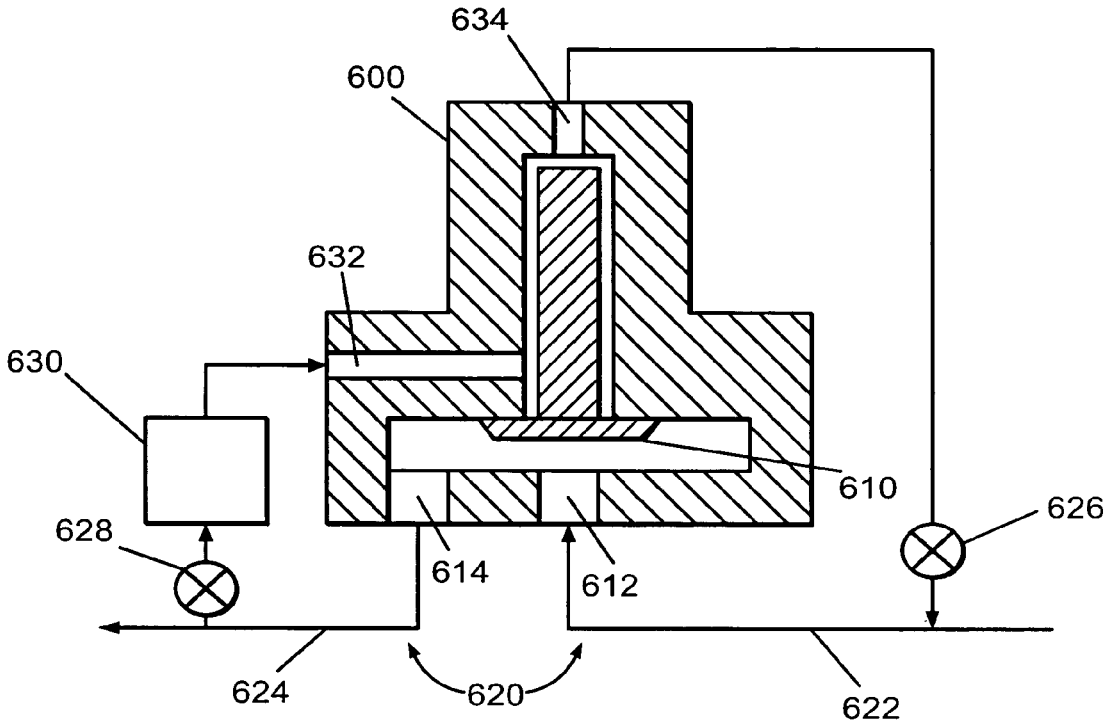
FIG. 6A depicts a system configured to cool a pump according to an embodiment.

As illustrated in FIG. 6A, one embodiment is provided for cooling a high temperature pump 600 associated with fluid flow system 120 (or 220, described below with reference to FIG. 2) by diverting high pressure fluid from a primary flow line 620 to the high pressure processing chamber 110 (or 210) through a heat exchanger 630, through the pump 600, and back to the primary flow line 620. For example, a pump impeller 610 housed within pump 600 can move high pressure fluid from a suction side 622 of primary flow line 620 through an inlet 612 and through an outlet 614 to a pressure side 624 of the primary flow line 620. A fraction of high pressure fluid can be diverted through an inlet valve 628, through heat exchanger 630, and enter pump 600 through coolant inlet 632. Thereafter, the fraction of high pressure fluid utilized for cooling can exit from pump 600 at coolant outlet 634 and return to the primary flow line 620 through outlet valve 626.

Figure 6B:
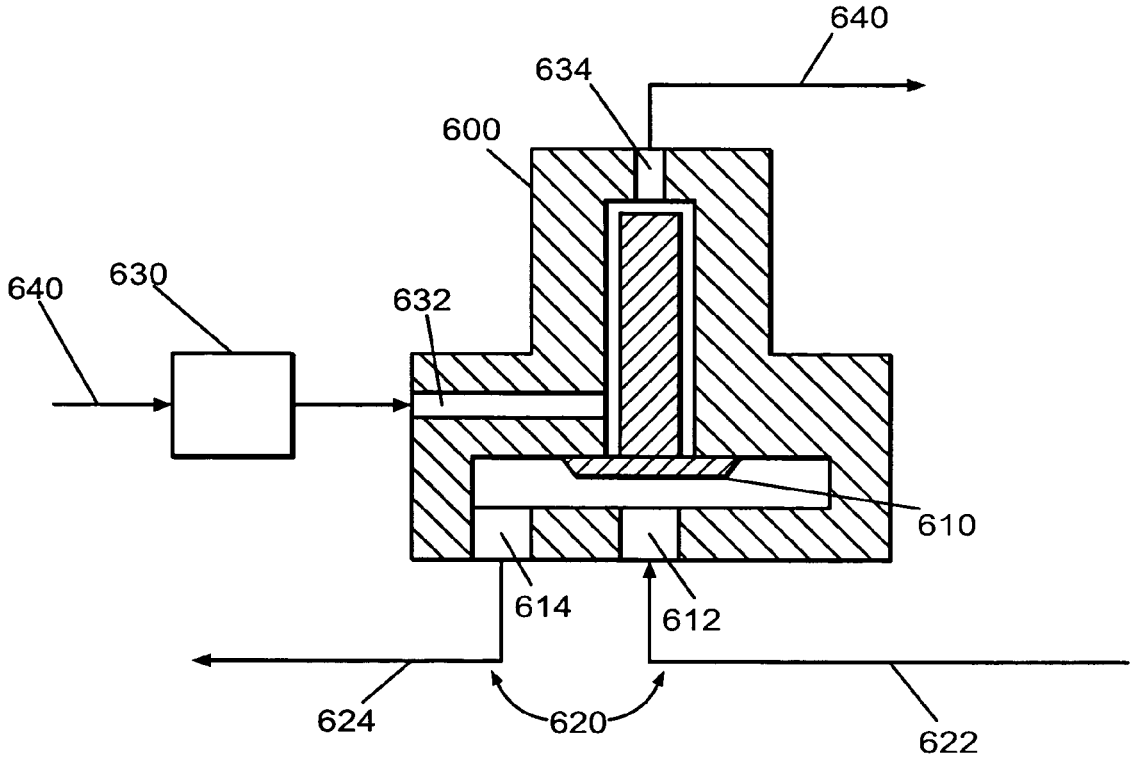
FIG. 6B depicts a system configured to cool a pump according to another embodiment.

Alternatively, as illustrated in FIG. 6B, another embodiment is provided for cooling pump 600 using a secondary flow line 640. A high pressure fluid, such as a supercritical fluid, from a fluid source (not shown) is directed through heat exchanger 630 (to lower the temperature of the fluid), and then enters pump 600 through coolant inlet 632, passes through pump 600, exits through coolant outlet 634, and continues to a discharge system (not shown). The fluid source can include a supercritical fluid source, such as a supercritical carbon dioxide source. The fluid source may or may not be a member of the high pressure fluid supply system 140 (or 240) described in FIG. 1 (or FIG. 2). The discharge system can include a vent, or the discharge system can include a recirculation system having a pump configured to recirculate the high pressure fluid through the heat exchanger 630 and pump 600.

Figure 7:
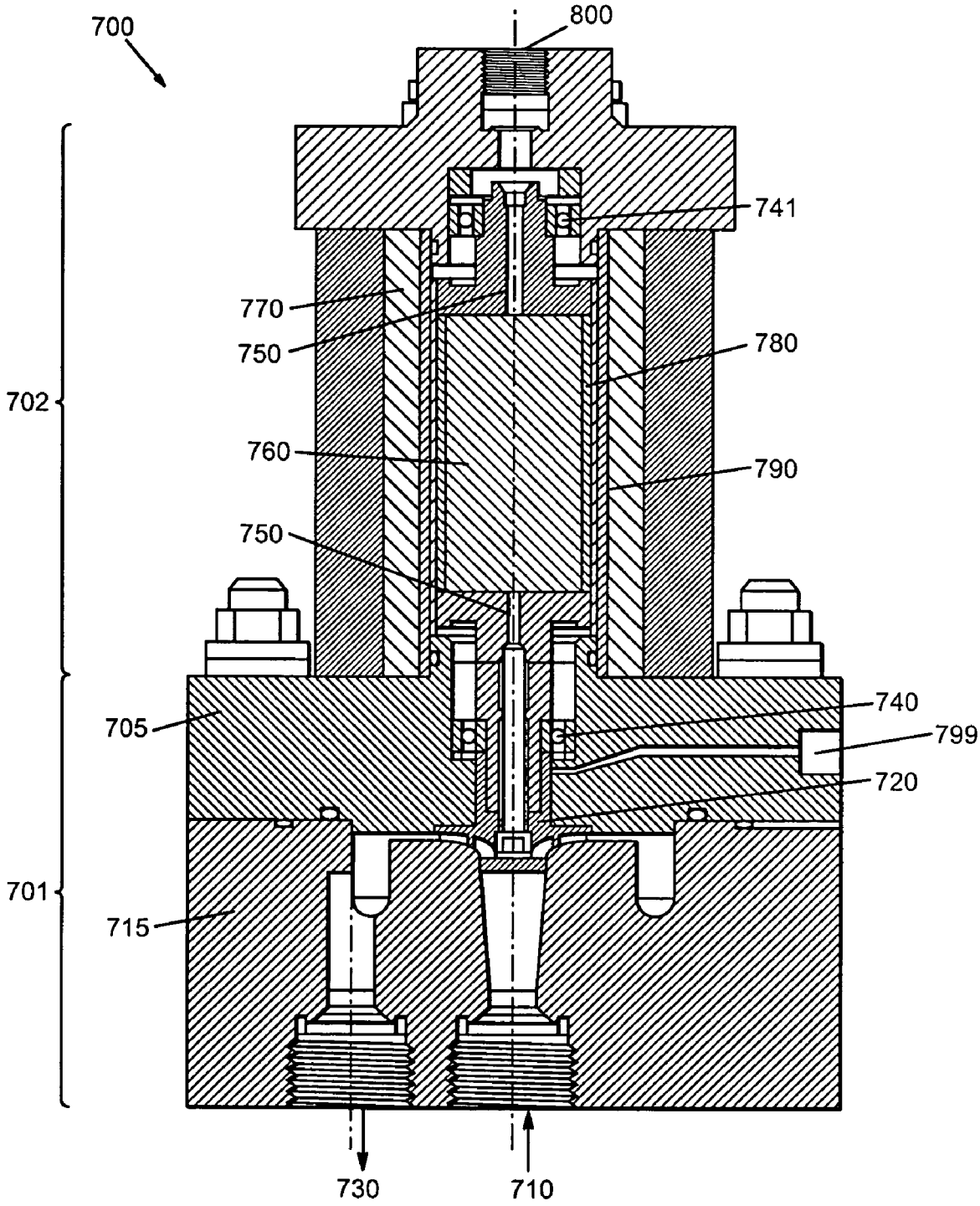
FIG. 7 provides a cross-sectional view of a pumping system according to another embodiment.

In yet another embodiment, the pump depicted in FIGS. 6A and 6B can include the pump assembly provided in FIG. 7. As illustrated in FIG. 7, a brushless compact canned pump assembly 700 is shown having a pump section 701 and a motor section 702. The motor section 702 drives the pump section 701. The pump section 701 incorporates a centrifugal impeller 720 rotating within the pump section 701, which includes an inner pump housing 705 and an outer pump housing 715. An inlet 710 (on the suction side of pump assembly 700) delivers pump fluid to the impeller 720, and the impeller 720 pumps the fluid to an outlet 730 (on the pressure side of the pump assembly 700).

The motor section 702 includes an electric motor having a stator 770 and a rotor 760. The electric motor can be a variable speed motor which allows for changing speed and/or load characteristics. Alternatively, the electric motor can be an induction motor. The rotor 760 is formed inside a non-magnetic stainless steel sleeve 780. The rotor 760 is canned to isolate it from contact with the fluid. The rotor 760 preferably has a diameter between 1.5 inches and 2 inches. The stator 770 is also canned to isolate it from the fluid being pumped. A pump shaft 750 extends away from the motor section 702 to the pump section 701 where it is affixed to an end of the impeller 720. The pump shaft 750 can be welded to the stainless steel sleeve 780 such that torque is transferred through the stainless steel sleeve 780. The impeller 720 preferably has a diameter between 1 inch and 2 inches, and includes rotating blades. The rotor 760 can, for instance, have a maximum speed of 60,000 revolutions per minute (rpm); however, it may be more or it may be less. Of course other speeds and other impeller sizes will achieve different flow rates. With brushless DC technology, the rotor 760 is actuated by electromagnetic fields that are generated by electric current flowing through windings of the stator 770. During operation, the pump shaft 750 transmits torque from the motor section 702 to the pump section 701 to pump the fluid. The motor section 702 can include an electrical controller (not shown) suitable for operating the pump assembly 700. The electrical controller (not shown) can include a commutation controller (not shown) for sequentially firing or energizing the windings of the stator 770.

The rotor 760 is potted in epoxy and encased in the stainless steel sleeve 780 to isolate the rotor 760 from the fluid. The stainless steel sleeve 780 creates a high pressure and substantially hermetic seal. The stainless steel sleeve 780 has a high resistance to corrosion and maintains high strength at very high temperatures, which substantially eliminates the generation of particles. Chromium, nickel, titanium, and other elements can also be added to stainless steels in varying quantities to produce a range of stainless steel grades, each with different properties.

The stator 770 is also potted in epoxy and sealed from the fluid via a polymer sleeve 790. The polymer sleeve 790 is preferably a PEEK™ (Polyetheretherketone) sleeve. The PEEK™ sleeve forms a casing for the stator 770. Because the polymer sleeve 790 is an exceptionally strong, highly crosslinked engineering thermoplastic, it resists chemical attack and permeation by $CO_2$ even at supercritical conditions and substantially eliminates the generation of particles. Further, the PEEK™ material has a low coefficient of friction and is inherently flame retardant. Other high-temperature and corrosion resistant materials, including alloys, can be used to seal the stator 770 from the fluid.

The pump shaft 750 is supported by a first corrosion resistant bearing 740 and a second corrosion resistant bearing 741. The bearings 740 and 741 can be ceramic bearings, hybrid bearings, full complement bearings, foil journal bearings, or magnetic bearings. The bearings 740 and 741 can be made of silicon nitride balls combined with bearing races made of Cronidur™ 30.

Additionally, pump assembly 700 includes coolant inlet 799 and coolant outlet 800 configured to permit the flow of a coolant through pump assembly 700 for cooling.

Referring again to FIG. 1, the processing system 100 can comprise high pressure fluid supply system 140. The high pressure fluid supply system 140 can be coupled to the fluid flow system 120, but this is not required. In alternate embodiments, high pressure fluid supply system 140 can be configured differently and coupled differently. For example, the fluid supply system 140 can be coupled directly to the processing chamber 110. The high pressure fluid supply system 140 can include a supercritical fluid supply system. A supercritical fluid as referred to herein is a fluid that is in a supercritical state, which is that state that exists when the fluid is maintained at or above the critical pressure and at or above the critical temperature on its phase diagram. In such a supercritical state, the fluid possesses certain properties, one of which is the substantial absence of surface tension. Accordingly, a supercritical fluid supply system, as referred to herein, is one that delivers to a processing chamber a fluid that assumes a supercritical state at the pressure and temperature at which the processing chamber is being controlled. Furthermore, it is only necessary that at least at or near the critical point the fluid is in substantially a supercritical state at which its properties are sufficient, and exist long enough, to realize their advantages in the process being performed. Carbon dioxide, for example, is a supercritical fluid when maintained at or above a pressure of about 1070 psi at a temperature of 31° C. This state of the fluid in the processing chamber may be maintained by operating the processing chamber at 2000 to 10000 psi at a temperature of approximately 80° C. or greater.

As described above, the fluid supply system 140 can include a supercritical fluid supply system, which can be a carbon dioxide supply system. For example, the fluid supply system 140 can be configured to introduce a high pressure fluid having a pressure substantially near the critical pressure for the fluid. Additionally, the fluid supply system 140 can be configured to introduce a supercritical fluid, such as carbon dioxide in a supercritical state. Additionally, for example, the fluid supply system 140 can be configured to introduce a supercritical fluid, such as supercritical carbon dioxide, at a pressure ranging from approximately the critical pressure of carbon dioxide to 10,000 psi. Examples of other supercritical fluid species useful in the broad practice of the invention include, but are not limited to, carbon dioxide (as described above), oxygen, argon, krypton, xenon, ammonia, methane, methanol, dimethyl ketone, hydrogen, water, and sulfur hexafluoride. The fluid supply system can, for example, comprise a carbon dioxide source (not shown) and a plurality of flow control elements (not shown) for generating a supercritical fluid. For example, the carbon dioxide source can include a $CO_2$ feed system, and the flow control elements can include supply lines, valves, filters, pumps, and heaters. The fluid supply system 140 can comprise an inlet valve (not shown) that is configured to open and close to allow or prevent the stream of supercritical carbon dioxide from flowing into the processing chamber 110. For example, controller 150 can be used to determine fluid parameters such as pressure, temperature, process time, and flow rate.

Referring still to FIG. 1, the process chemistry supply system 130 is coupled to the fluid flow system 120, but this is not required for the invention. In alternate embodiments, the process chemistry supply system 130 can be configured differently, and can be coupled to different elements in the processing system 100. The process chemistry is introduced by the process chemistry supply system 130 into the fluid introduced by the fluid supply system 140 at ratios that vary with the substrate properties, the chemistry being used and the process being performed in the processing chamber 110. Usually the ratio is roughly 1 to 15 percent by volume, which, for a chamber, recirculation system and associated plumbing having a volume of about one liter amounts to about 10 to 150 milliliters of additive in most cases, but the ratio may be higher or lower.

The process chemistry supply system 130 can be configured to introduce one or more of the following process compositions, but not limited to: cleaning compositions for removing contaminants, residues, hardened residues, photoresist, hardened photoresist, post-etch residue, post-ash residue, post chemical-mechanical polishing (CMP) residue, post-polishing residue, or post-implant residue, or any combination thereof; cleaning compositions for removing particulate; drying compositions for drying thin films, porous thin films, porous low dielectric constant materials, or air-gap dielectrics, or any combination thereof; film-forming compositions for preparing dielectric thin films, metal thin films, or any combination thereof; healing compositions for restoring the dielectric constant of low dielectric constant (low-k) films; sealing compositions for sealing porous films; or any combination thereof. Additionally, the process chemistry supply system 130 can be configured to introduce solvents, co-solvents, surfactants, etchants, acids, bases, chelators, oxidizers, film-forming precursors, or reducing agents, or any combination thereof.

The process chemistry supply system 130 can be configured to introduce N-methyl pyrrolidone (NMP), diglycol amine, hydroxyl amine, di-isopropyl amine, tri-isopropyl amine, tertiary amines, catechol, ammonium fluoride, ammonium bifluoride, methylacetoacetamide, ozone, propylene glycol monoethyl ether acetate, acetylacetone, dibasic esters, ethyl lactate, $CHF_3$, $BF_3$, HF, other fluorine containing chemicals, or any mixture thereof. Other chemicals such as organic solvents may be utilized independently or in conjunction with the above chemicals to remove organic materials. The organic solvents may include, for example, an alcohol, ether, and/or glycol, such as acetone, diacetone alcohol, dimethyl sulfoxide (DMSO), ethylene glycol, methanol, ethanol, propanol, or isopropanol (IPA). For further details, see U.S. Pat. No. 6,306,564B1, filed May 27, 1998, and titled "REMOVAL OF RESIST OR RESIDUE FROM SEMICONDUCTORS USING SUPERCRITICAL CARBON DIOXIDE", and U.S. Pat. No. 6,509,141B2, filed Sep. 3, 1999, and titled "REMOVAL OF PHOTORESIST AND PHOTORESIST RESIDUE FROM SEMICONDUCTORS USING SUPERCRITICAL CARBON DIOXIDE PROCESS," both incorporated by reference herein.

Additionally, the process chemistry supply system 130 can comprise a cleaning chemistry assembly (not shown) for providing cleaning chemistry for generating supercritical cleaning solutions within the processing chamber. The cleaning chemistry can include peroxides and a fluoride source. For example, the peroxides can include hydrogen peroxide, benzoyl peroxide, or any other suitable peroxide, and the fluoride sources can include fluoride salts (such as ammonium fluoride salts), hydrogen fluoride, fluoride adducts (such as organo-ammonium fluoride adducts), and combinations thereof. Further details of fluoride sources and methods of generating supercritical processing solutions with fluoride sources are described in U.S. patent application Ser. No. 10/442,557, filed May 20, 2003, and titled "TETRA-ORGANIC AMMONIUM FLUORIDE AND HF IN SUPERCRITICAL FLUID FOR PHOTORESIST AND RESIDUE REMOVAL", and U.S. patent application Ser. No. 10/321,341, filed Dec. 16, 2002, and titled "FLUORIDE IN SUPERCRITICAL FLUID FOR PHOTORESIST POLYMER AND RESIDUE REMOVAL," both incorporated by reference herein.

Furthermore, the process chemistry supply system 130 can be configured to introduce chelating agents, complexing agents and other oxidants, organic and inorganic acids that can be introduced into the supercritical fluid solution with one or more carrier solvents, such as N, N-dimethylacetamide (DMAc), gamma-butyrolactone (BLO), dimethyl sulfoxide (DMSO), ethylene carbonate (EC), N-methyl pyrrolidone (NMP), dimethylpiperidone, propylene carbonate, and alcohols (such a methanol, ethanol and 2-propanol).

Moreover, the process chemistry supply system 130 can comprise a rinsing chemistry assembly (not shown) for providing rinsing chemistry for generating supercritical rinsing solutions within the processing chamber. The rinsing chemistry can include one or more organic solvents including, but not limited to, alcohols and ketone. In one embodiment, the rinsing chemistry can comprise sulfolane, also known as thiocyclopentane-1,1-dioxide, (cyclo)tetramethylene sulphone and 2,3,4,5-tetrahydrothiophene-1,1-dioxide, which can be purchased from a number of venders, such as Degussa Stanlow Limited, Lake Court, Hursley Winchester SO21 2LD UK.

Moreover, the process chemistry supply system 130 can be configured to introduce treating chemistry for curing, cleaning, healing (or restoring the dielectric constant of low-k materials), or sealing, or any combination, low dielectric constant films (porous or non-porous). The chemistry can include hexamethyldisilazane (HMDS), chlorotrimethylsilane (TMCS), trichloromethylsilane (TCMS), dimethylsilyldiethylamine (DMSDEA), tetramethyldisilazane (TMDS), trimethylsilyldimethylamine (TMSDMA), dimethylsilyldimethylamine (DMSDMA), trimethylsilyidiethylamine (TMSDEA), bistrimethylsilyl urea (BTSU), bis(dimethylamino)methyl silane (B[DMA]MS), bis(dimethylamino)dimethyl silane (B[DMA]DS), HMCTS, dimethylaminopentamethyldisilane (DMAPMDS), dimethylaminodimethyldisilane (DMADMDS), disila-aza-cyclopentane (TDACP), disila-oza-cyclopentane (TDOCP), methyltrimethoxysilane (MTMOS), vinyltrimethoxysilane (VTMOS), or trimethylsilylimidazole (TMSI). Additionally, the chemistry may include N-tert-butyl-1,1-dimethyl-1-(2,3,4,5-tetramethyl-2,4-cyclopentadiene-1-yl)silanamine, 1,3-diphenyl-1,1,3,3-tetramethyldisilazane, or tert-butylchlorodiphenylsilane. For further details, see U.S. patent application Ser. No. 10/682,196, filed Oct. 10, 2003, and titled "METHOD AND SYSTEM FOR TREATING A DIELECTRIC FILM," and U.S. patent application Ser. No. 10/379,984, filed Mar. 4, 2003, and titled "METHOD OF PASSIVATING LOW DIELECTRIC MATERIALS IN WAFER PROCESSING," both incorporated by reference herein.

Additionally, the process chemistry supply system 130 can be configured to introduce peroxides during, for instance, cleaning processes. The peroxides can include organic peroxides, or inorganic peroxides, or a combination thereof. For example, organic peroxides can include 2-butanone peroxide; 2,4-pentanedione peroxide; peracetic acid; t-butyl hydroperoxide; benzoyl peroxide; or m-chloroperbenzoic acid (mCPBA). Other peroxides can include hydrogen peroxide.

The processing chamber 110 can be configured to process substrate 105 by exposing the substrate 105 to fluid from the fluid supply system 140, or process chemistry from the process chemistry supply system 130, or a combination thereof in a processing space 112. Additionally, processing chamber 110 can include an upper chamber assembly 114, and a lower chamber assembly 115.

The upper chamber assembly 112 can comprise a heater (not shown) for heating the processing chamber 110, the substrate 105, or the processing fluid, or a combination of two or more thereof. Alternately, a heater is not required. Additionally, the upper chamber assembly 112 can include flow components for flowing a processing fluid through the processing chamber 110. In one example, a circular flow pattern can be established. Alternately, the flow components for flowing the fluid can be configured differently to affect a different flow pattern. Alternatively, the upper chamber assembly 112 can be configured to fill the processing chamber 110.

The lower chamber assembly 115 can include a platen 116 configured to support substrate 105 and a drive mechanism 118 for translating the platen 116 in order to load and unload substrate 105, and seal lower chamber assembly 115 with upper chamber assembly 114. The platen 116 can also be configured to heat or cool the substrate 105 before, during, and/or after processing the substrate 105. For example, the platen 116 can include one or more heater rods configured to elevate the temperature of the platen to approximately 80° C. or greater. Additionally, the lower assembly 115 can include a lift pin assembly for displacing the substrate 105 from the upper surface of the platen 116 during substrate loading and unloading.

Additionally, controller 150 includes a temperature control system coupled to one or more of the processing chamber 110, the fluid flow system 120 (or recirculation system), the platen 116, the high pressure fluid supply system 140, or the process chemistry supply system 130. The temperature control system is coupled to heating elements embedded in one or more of these systems, and configured to elevate the temperature of the supercritical fluid to approximately 80° C. or greater. The heating elements can, for example, include resistive heating elements.

A transfer system (not shown) can be used to move a substrate into and out of the processing chamber 110 through a slot (not shown). In one example, the slot can be opened and closed by moving the platen 116, and in another example, the slot can be controlled using a gate valve (not shown).

The substrate can include semiconductor material, metallic material, dielectric material, ceramic material, or polymer material, or a combination of two or more thereof. The semiconductor material can include Si, Ge, Si/Ge, or GaAs. The metallic material can include Cu, Al, Ni, Pb, Ti, and/or Ta. The dielectric material can include silica, silicon dioxide, quartz, aluminum oxide, sapphire, low dielectric constant materials, Teflon®, and/or polyimide. The ceramic material can include aluminum oxide, silicon carbide, etc.

The processing system 100 can also comprise a pressure control system (not shown). The pressure control system can be coupled to the processing chamber 110, but this is not required. In alternate embodiments, the pressure control system can be configured differently and coupled differently. The pressure control system can include one or more pressure valves (not shown) for exhausting the processing chamber 110 and/or for regulating the pressure within the processing chamber 110. Alternately, the pressure control system can also include one or more pumps (not shown). For example, one pump may be used to increase the pressure within the processing chamber, and another pump may be used to evacuate the processing chamber 110. In another embodiment, the pressure control system can comprise seals for sealing the processing chamber. In addition, the pressure control system can comprise an elevator for raising and lowering the substrate 105 and/or the platen 116.

Furthermore, the processing system 100 can comprise an exhaust control system. The exhaust control system can be coupled to the processing chamber 110, but this is not required. In alternate embodiments, the exhaust control system can be configured differently and coupled differently. The exhaust control system can include an exhaust gas collection vessel (not shown) and can be used to remove contaminants from the processing fluid. Alternately, the exhaust control system can be used to recycle the processing fluid.

Figure 2:
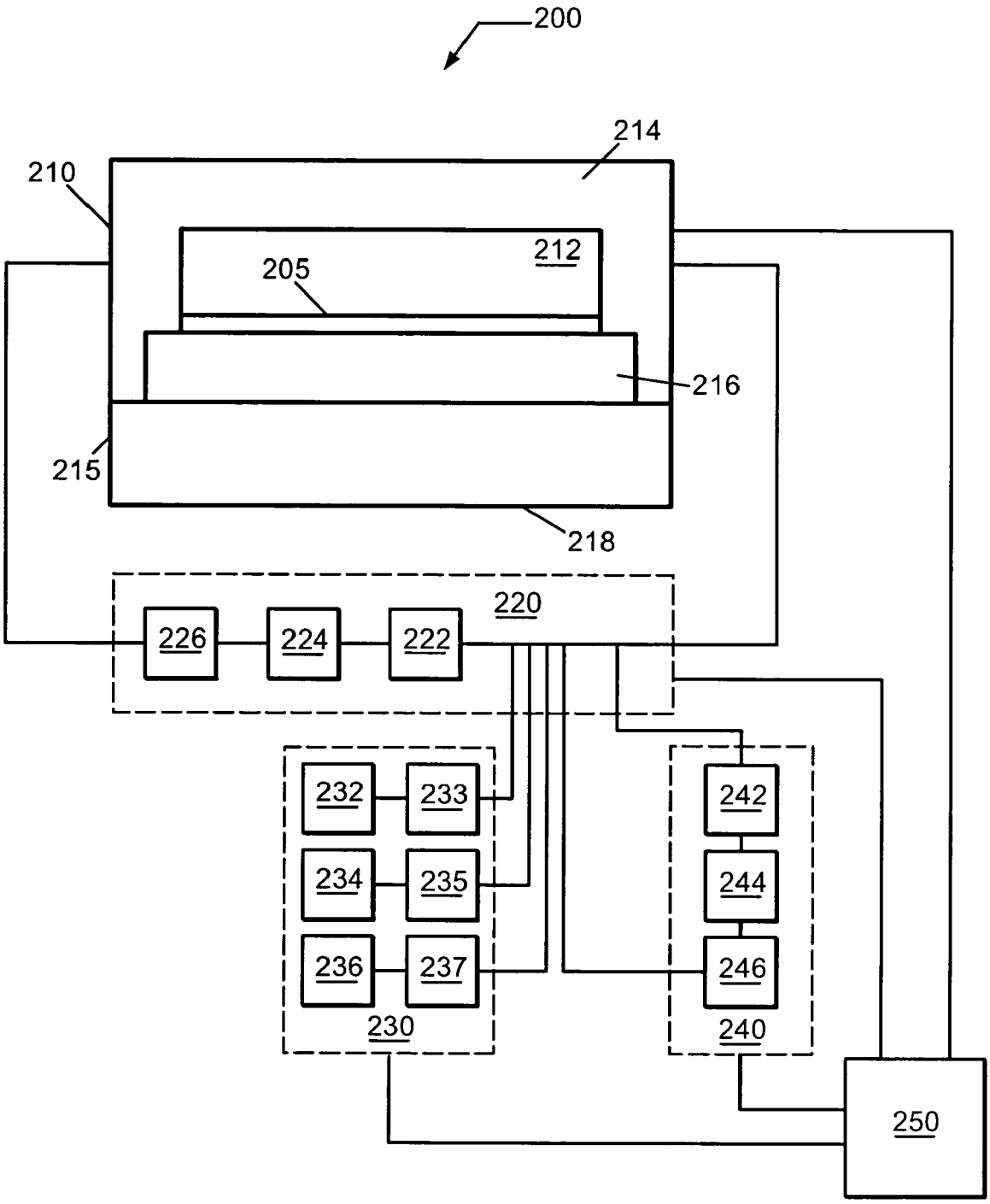
FIG. 2 presents another simplified schematic representation of a processing system.

Referring now to FIG. 2, a processing system 200 is presented according to another embodiment. In the illustrated embodiment, processing system 200 comprises a processing chamber 210, a recirculation system 220, a process chemistry supply system 230, a fluid supply system 240, and a controller 250, all of which are configured to process substrate 205. The controller 250 can be coupled to the processing chamber 210, the recirculation system 220, the process chemistry supply system 230, and the fluid supply system 240. Alternately, controller 250 can be coupled to a one or more additional controllers/computers (not shown), and controller 250 can obtain setup and/or configuration information from an additional controller/computer.

As shown in FIG. 2, the recirculation system 220 can include a recirculation fluid heater 222, a pump 224, and a filter 226. The process chemistry supply system 230 can include one or more chemistry introduction systems, each introduction system having a chemical source 232, 234, 236, and an injection system 233, 235, 237. The injection systems 233, 235, 237 can include a pump (not shown) and an injection valve (not shown). The fluid supply system 240 can include a supercritical fluid source 242, a pumping system 244, and a supercritical fluid heater 246. In addition, one or more injection valves and/or exhaust valves may be utilized with the fluid supply system 240.

The processing chamber 210 can be configured to process substrate 205 by exposing the substrate 205 to fluid from the fluid supply system 240, or process chemistry from the process chemistry supply system 230, or a combination thereof in a processing space 212. Additionally, processing chamber 210 can include an upper chamber assembly 214, and a lower chamber assembly 215 having a platen 216 and drive mechanism 218, as described above with reference to FIG. 1.

Figure 3:
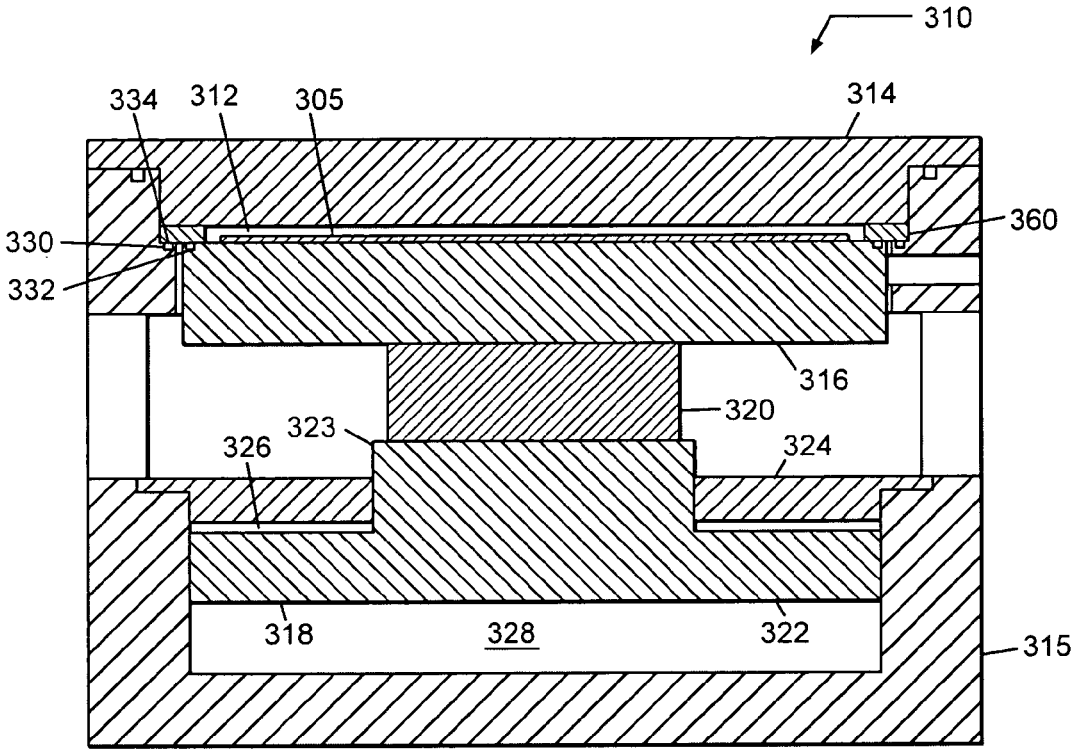
FIG. 3 presents another simplified schematic representation of a processing system.

Alternatively, the processing chamber 210 can be configured as described in pending U.S. patent application Ser. No. 09/912,844 (US Patent Application Publication No. 2002/0046707 A1), entitled "High Pressure Processing Chamber for Semiconductor Substrates", and filed on Jul. 24, 2001, which is incorporated herein by reference in its entirety. For example, FIG. 3 depicts a cross-sectional view of a supercritical processing chamber 310 comprising upper chamber assembly 314, lower chamber assembly 315, platen 316 configured to support substrate 305, and drive mechanism 318 configured to raise and lower platen 316 between a substrate loading/unloading condition and a substrate processing condition. Drive mechanism 318 can further include a drive cylinder 320, drive piston 322 having piston neck 323, sealing plate 324, pneumatic cavity 326, and hydraulic cavity 328. Additionally, supercritical processing chamber 310 further includes a plurality of sealing devices 330, 332, and 334 for providing a sealed, high pressure process space 312 in the processing chamber 310.

Figure 4A:
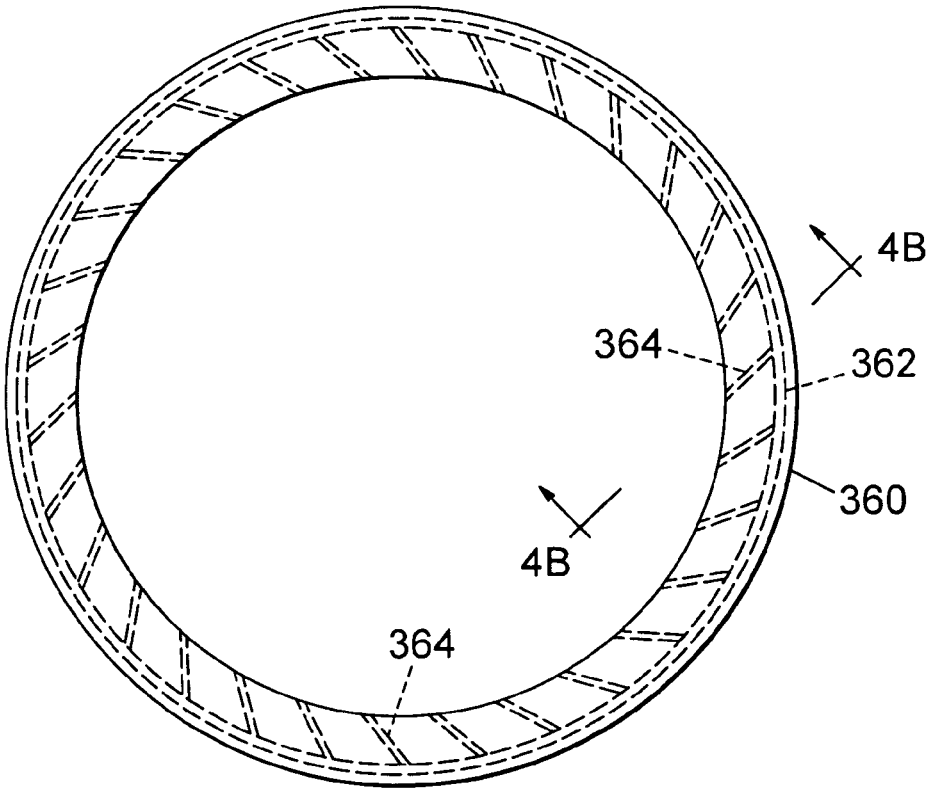
FIGS. 4A and 4B depict a fluid injection manifold for introducing fluid to a processing system.
Figure 4B:
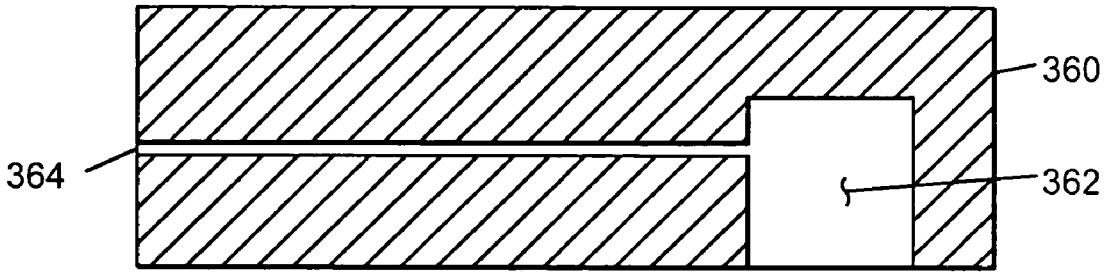

As described above with reference to FIGS. 1, 2, and 3, the fluid flow or recirculation system coupled to the processing chamber is configured to circulate the fluid through the processing chamber, and thereby permit the exposure of the substrate in the processing chamber to a flow of fluid. The fluid, such as supercritical carbon dioxide with or without process chemistry, can enter the processing chamber at a peripheral edge of the substrate through one or more inlets coupled to the fluid flow system. For example, referring now to FIG. 3 and FIGS. 4A and 4B, an injection manifold 360 is shown as a ring having an annular fluid supply channel 362 coupled to one or more inlets 364. The one or more inlets 364, as illustrated, include forty five (45) injection orifices canted at 45 degrees, thereby imparting azimuthal momentum, or axial momentum, or both, as well as radial momentum to the flow of high pressure fluid through process space 312 above substrate 305. Although shown to be canted at an angle of 45 degrees, the angle may be varied, including direct radial inward injection.

Additionally, the fluid, such as supercritical carbon dioxide, exits the processing chamber adjacent a surface of the substrate through one or more outlets (not shown). For example, as described in U.S. patent application Ser. No. 09/912,844, the one or more outlets can include two outlet holes positioned proximate to and above the center of substrate 305. The flow through the two outlets can be alternated from one outlet to the next outlet using a shutter valve.

Figure 5:
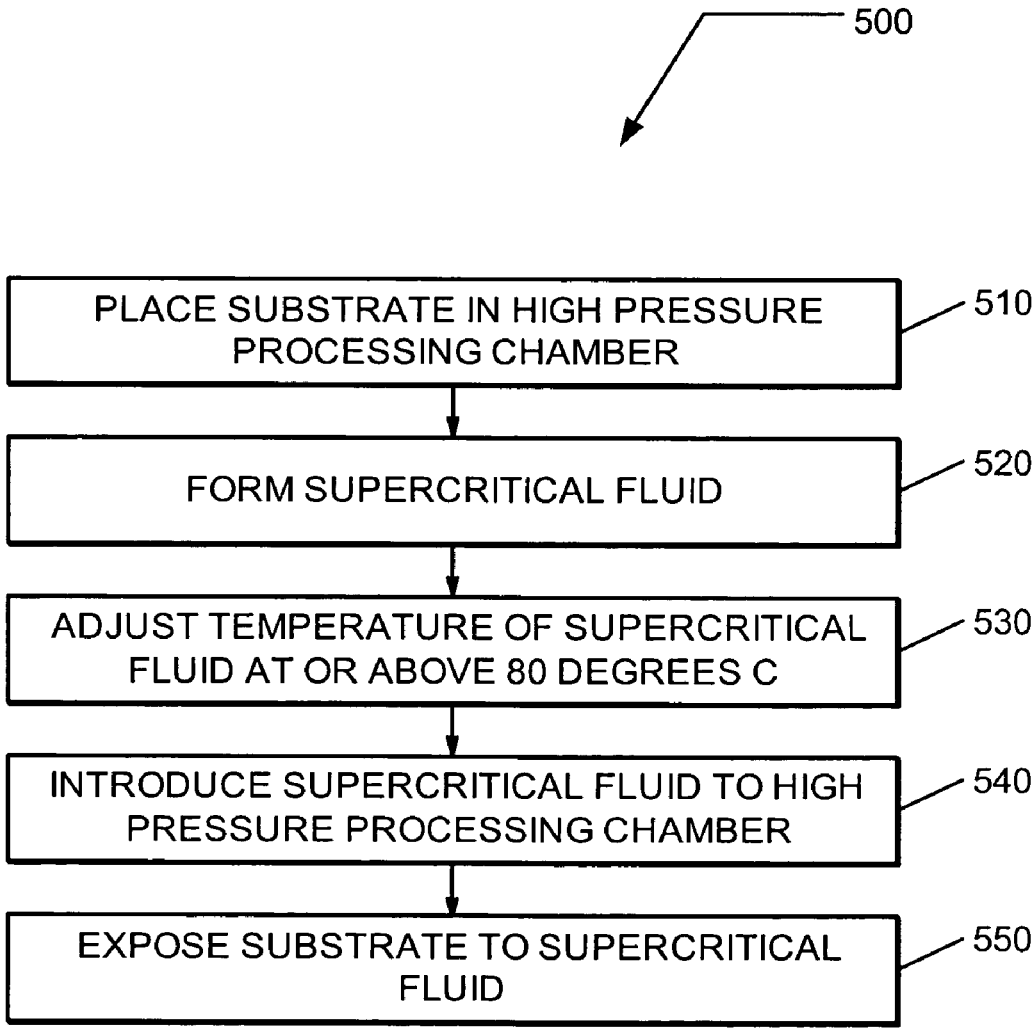
FIG. 5 illustrates a method of treating a substrate in a processing system according to an embodiment of the invention.

Referring now to FIG. 5, a method of treating a substrate with a fluid in a supercritical state is provided. As depicted in flow chart 500, the method begins in 510 with placing a substrate onto a platen within a high pressure processing chamber configured to expose the substrate to a supercritical fluid processing solution.

In 520, a supercritical fluid is formed by bringing a fluid to a subcritical state by adjusting the pressure of the fluid to at or above the critical pressure of the fluid, and adjusting the temperature of the fluid to at or above the critical temperature of the fluid. In 530, the temperature of the supercritical fluid is further elevated to a value equal to or greater than 80° C.

In 540, the supercritical fluid is introduced to the high pressure processing chamber and, in 550, the substrate is exposed to the supercritical fluid.

Additionally, as described above, a process chemistry can be added to the supercritical fluid during processing. The process chemistry can comprise a cleaning composition, a film forming composition, a healing composition, or a sealing composition, or any combination thereof. For example, the process chemistry can comprise a cleaning composition having a peroxide. In each of the following examples, the temperature of the supercritical fluid is elevated above approximately 80° C. and is, for example, 135° C. Furthermore, in each of the following examples, the pressure of the supercritical fluid is above the critical pressure and is, for instance, 2900 psi. In one example, the cleaning composition can comprise hydrogen peroxide combined with, for instance, a mixture of methanol (MeOH) and acetic acid (AcOH). By way of further example, a process recipe for removing post-etch residue(s) can comprise three steps including: (1) exposure of the substrate to supercritical carbon dioxide for approximately two minutes; (2) exposure of the substrate to 1 milliliter (ml) of 50% hydrogen peroxide (by volume) in water and 20 ml of 1:1 ratio MeOH:AcOH in supercritical carbon dioxide for approximately three minutes; and (3) exposure of the substrate to 13 ml of 12:1 ratio MeOH:$H_2O$ in supercritical carbon dioxide for approximately three minutes. The second step can be repeated any number of times, for instance, it may be repeated twice. Moreover, any step may be repeated. Additionally, the time duration for each step, or sub-step, may be varied greater than or less than those specified. Further yet, the amount of any additive may be varied greater than or less than those specified, and the ratios may be varied.

In another example, the cleaning composition can comprise a mixture of hydrogen peroxide and pyridine combined with, for instance, methanol (MeOH). By way of further example, a process recipe for removing post-etch residue(s) can comprise two steps including: (1) exposure of the substrate to 20 milliliters (ml) of MeOH and 13 ml of 10:3 ratio (by volume) of pyridine and 50% hydrogen peroxide (by volume) in water in supercritical carbon dioxide for approximately five minutes; and (2) exposure of the substrate to 10 ml of N-methyl pyrrolidone (NMP) in supercritical carbon dioxide for approximately two minutes. The first step can be repeated any number of times, for instance, it may be repeated once. Moreover, any step may be repeated. Additionally, the time duration for each step, or sub-step, may be varied greater than or less than those specified. Further yet, the amount of any additive may be varied greater than or less than those specified.

In another example, the cleaning composition can comprise 2-butanone peroxide combined with, for instance, a mixture of methanol (MeOH) and acetic acid. By way of further example, a process recipe for removing post-etch residue(s) can comprise three steps including: (1) exposure of the substrate to supercritical carbon dioxide for approximately two minutes; (2) exposure of the substrate to 4 milliliters (ml) of 2-butanone peroxide (such as Luperox DHD-9, which is 32% by volume of 2-butanone peroxide in 2,2,4-trimethyl-1,3-pentanediol diisobutyrate) and 12.5 ml of 1:1 ratio MeOH:AcOH in supercritical carbon dioxide for approximately three minutes; and (3) exposure of the substrate to 13 ml of 12:1 ratio MeOH:$H_2O$ in supercritical carbon dioxide for approximately three minutes. The second step can be repeated any number of times, for instance, it may be repeated twice. Moreover, any step may be repeated. Additionally, the time duration for each step, or sub-step, may be varied greater than or less than those specified. Further yet, the amount of any additive may be varied greater than or less than those specified, and the ratios may be varied.

In another example, the cleaning composition can comprise 2-butanone peroxide combined with, for instance, a mixture of methanol (MeOH) and acetic acid. By way of further example, a process recipe for removing post-etch residue(s) can comprise three steps including: (1) exposure of the substrate to supercritical carbon dioxide for approximately two minutes; (2) exposure of the substrate to 8 milliliters (ml) of 2-butanone peroxide (such as Luperox DHD-9, which is 32% by volume of 2-butanone peroxide in 2,2,4-trimethyl-1,3-pentanediol diisobutyrate) and 16 ml of 1:1 ratio MeOH:AcOH in supercritical carbon dioxide for approximately three minutes; and (3) exposure of the substrate to 13 ml of 12:1 ratio MeOH:$H_2O$ in supercritical carbon dioxide for approximately three minutes. The second step can be repeated any number of times, for instance, it may be repeated twice. Moreover, any step may be repeated. Additionally, the time duration for each step, or sub-step, may be varied greater than or less than those specified. Further yet, the amount of any additive may be varied greater than or less than those specified, and the ratios may be varied.

In another example, the cleaning composition can comprise peracetic acid combined with, for instance, a mixture of methanol (MeOH) and acetic acid. By way of further example, a process recipe for removing post-etch residue(s) can comprise three steps including: (1) exposure of the substrate to supercritical carbon dioxide for approximately two minutes; (2) exposure of the substrate to 4.5 milliliter (ml) of peracetic acid (32% by volume of peracetic acid in dilute acetic acid) and 16.5 ml of 1:1 ratio MeOH:AcOH in supercritical carbon dioxide for approximately three minutes; and (3) exposure of the substrate to 13 ml of 12:1 ratio MeOH:$H_2O$ in supercritical carbon dioxide for approximately three minutes. The second step can be repeated any number of times, for instance, it may be repeated twice. Moreover, any step may be repeated. Additionally, the time duration for each step, or sub-step, may be varied greater than or less than those specified. Further yet, the amount of any additive may be varied greater than or less than those specified, and the ratios may be varied.

In another example, the cleaning composition can comprise 2,4-pentanedione peroxide combined with, for instance, N-methyl pyrrolidone (NMP). By way of further example, a process recipe for removing post-etch residue(s) can comprise two steps including: (1) exposure of the substrate to supercritical carbon dioxide for approximately two minutes; and (2) exposure of the substrate to 3 milliliter (ml) of 2,4-pentanedione peroxide (for instance, 34% by volume in 4-hydroxy-4-methyl-2-pentanone and N-methyl pyrrolidone, or dimethyl phthalate and proprietary alcohols) and 20 ml of N-methyl pyrrolidone (NMP) in supercritical carbon dioxide for approximately three minutes. The second step can be repeated any number of times, for instance, it may be repeated twice. Moreover, any step may be repeated. Additionally, the time duration for each step, or sub-step, may be varied greater than or less than those specified. Further yet, the amount of any additive may be varied greater than or less than those specified, and the ratios may be varied.

Although only certain exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A fluid flow system for circulating a supercritical fluid through a high pressure processing system comprising:

a primary supercritical flow line coupled to said high pressure processing system, and configured to supply said supercritical fluid at a fluid temperature equal to or greater than 80° C. to said high pressure processing system;

a high temperature pump having an inlet for receiving said supercritical fluid from said primary supercritical flow line and an outlet coupled to said primary supercritical flow line and configured to return said supercritical fluid to said primary supercritical flow line and thereby move said supercritical fluid through said primary supercritical flow line to said high pressure processing system, wherein said high temperature pump comprises a coolant inlet configured to receive a coolant and a coolant outlet configured to discharge said coolant; and a heat exchanger coupled to said coolant inlet, and configured to lower a coolant temperature of said coolant to a temperature less than or equal to said fluid temperature of said supercritical fluid.

2. The fluid flow system of claim 1, wherein said primary supercritical flow line comprises a recirculation line having a first end coupled to an outlet of said high pressure processing system and a second end coupled to an inlet of said high pressure processing system with said high temperature pump coupled to said recirculation line therebetween.

3. The fluid flow system of claim 2, wherein said recirculation line further comprises one or more fluid filters.

4. The fluid flow system of claim 2, wherein said recirculation line further comprises a heating system configured to elevate said fluid temperature of said supercritical fluid.

5. The fluid flow system of claim 1, wherein an inlet of said heat exchanger is coupled to said primary supercritical flow line on a pressure side of said high temperature pump, and said coolant outlet of said high temperature pump is coupled to said primary supercritical flow line on a suction side of said high temperature pump.

6. The fluid flow system of claim 5, wherein a first valve is positioned between said coolant outlet and said primary supercritical flow line.

7. The fluid flow system of claim 6, wherein a second valve is positioned between said coolant outlet and said primary supercritical flow line.

8. The fluid flow line of claim 1, wherein said heat exchanger is coupled to a secondary flow line which is coupled to said coolant inlet, an inlet of said heat exchanger is coupled via said secondary flow line to a high pressure fluid source, and said coolant outlet of said high temperature pump is coupled via said secondary flow line to a discharge system.

9. The fluid flow system of claim 8, wherein said secondary flow line comprises a coolant pump configured to flow said coolant through said heat exchanger and said high temperature pump.

10. The fluid flow system of claim 8, wherein said discharge system is configured to return said coolant to said heat exchanger.

11. A fluid flow system for circulating a supercritical fluid through a high pressure processing system comprising:

a primary supercritical flow line having a first end coupled to an outlet of said high pressure processing system and a second end coupled to an inlet of said high pressure processing system, said primary supercritical flow line configured to supply said supercritical fluid at a fluid temperature equal to or greater than 80° C. to said high pressure processing system;

a high temperature pump having an inlet coupled to a suction side and configured to receive said supercritical fluid and an outlet coupled to a pressure side and configured to discharge said supercritical fluid, wherein said suction side is disposed between said outlet of said high pressure processing system and said high temperature pump and said pressure side is disposed between said high temperature pump and said inlet of said high pressure processing system, wherein said high temperature pump is configured to move said supercritical fluid through said primary supercritical flow line to said high pressure processing system, wherein said high temperature pump further comprises a coolant inlet configured to receive a coolant and a coolant outlet configured to discharge said coolant, and wherein said coolant outlet is coupled to said primary supercritical flow line on said suction side thereof; and a heat exchanger having an inlet coupled to said primary supercritical flow line on said pressure side for diverting supercritical fluid into said heat exchanger as said coolant, and having an outlet coupled to said coolant inlet, said heat exchanger configured to lower a coolant temperature of said coolant to a temperature less than or equal to said fluid temperature of said supercritical fluid.

12. The fluid flow system of claim 11, wherein said primary supercritical flow line further comprises a heating system configured to elevate said fluid temperature of said supercritical fluid.

13. The fluid flow system of claim 11, wherein a first valve is positioned between said heat exchanger and said primary supercritical flow line.

14. The fluid flow system of claim 13, wherein a second valve is positioned between said coolant outlet and said primary supercritical flow line.

* * * * *